US010203124B2

(12) United States Patent
Jeong

(10) Patent No.: US 10,203,124 B2
(45) Date of Patent: Feb. 12, 2019

(54) INDOOR DEVICE FOR AIR CONDITIONER HAVING WIND VISORS

(71) Applicant: LG Electronics Inc., Seoul (KR)

(72) Inventor: Changhoon Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 931 days.

(21) Appl. No.: 14/510,340

(22) Filed: Oct. 9, 2014

(65) Prior Publication Data

US 2015/0211756 A1 Jul. 30, 2015
US 2018/0073755 A9 Mar. 15, 2018

(30) Foreign Application Priority Data

Jan. 27, 2014 (KR) ..... 10-2014-0009419

(51) Int. Cl.

| | |
|---|---|
| ***F24F 13/08*** | (2006.01) |
| ***F24F 7/10*** | (2006.01) |
| ***F24F 13/14*** | (2006.01) |
| *F24F 1/10* | (2011.01) |
| *F24F 1/00* | (2011.01) |

(52) U.S. Cl.
CPC ..... *F24F 7/10* (2013.01); *F24F 1/0011* (2013.01); *F24F 1/0014* (2013.01); *F24F 13/082* (2013.01); *F24F 13/14* (2013.01); *F24F 2001/0037* (2013.01)

(58) Field of Classification Search
None
See application file for complete search history.

(56) References Cited

U.S. PATENT DOCUMENTS

| | | | |
|---|---|---|---|
| 5,642,608 | A | 7/1997 | Sanderson |
| 5,746,655 | A | 5/1998 | Lee |
| 5,769,710 | A | 6/1998 | Kim |
| 5,775,989 | A | 7/1998 | Choi |
| 5,788,570 | A | 8/1998 | Cho |
| 5,943,872 | A | 8/1999 | Sakurada et al. |

(Continued)

FOREIGN PATENT DOCUMENTS

| | | |
|---|---|---|
| CN | 2420551 | 2/2001 |
| CN | 1478188 | 2/2004 |

(Continued)

OTHER PUBLICATIONS

European Search Report issued in Application No. 14185283.0 dated Feb. 4, 2015.

(Continued)

*Primary Examiner* — Avinash A Savani
*Assistant Examiner* — Martha M Becton
(74) *Attorney, Agent, or Firm* — KED & Associates LLP

(57) ABSTRACT

An indoor device for an air conditioner having wind visors is provided. Each wind visor may have a shape corresponding to a shape of a respective discharge hole of the indoor device and may be directly rotatably mounted on a bottom surface of the indoor device to guide discharged air, thereby providing a simplified structure. A fixing portion, on which the wind visor may be installed, may be provided in the indoor device, and the wind visor may be rotatably coupled to the fixing portion through the simplified structure.

19 Claims, 20 Drawing Sheets

(56) References Cited

U.S. PATENT DOCUMENTS

| | | | | |
|---|---|---|---|---|
| 6,089,972 | A * | 7/2000 | Gunji | F24F 1/0011 454/233 |
| 6,250,373 | B1 * | 6/2001 | Vecchi | F24F 1/0007 165/125 |
| 6,264,552 | B1 * | 7/2001 | Oya | F24F 13/06 454/304 |
| 6,393,856 | B1 | 5/2002 | Gunji | |
| 6,598,413 | B2 * | 7/2003 | Asahina | F24F 1/0011 62/259.1 |
| 6,692,349 | B1 | 2/2004 | Brinkerhoff et al. | |
| 7,878,017 | B2 | 2/2011 | Yasutomi | |
| 7,908,879 | B1 | 3/2011 | Chen | |
| 7,992,794 | B2 | 8/2011 | Leen et al. | |
| 8,230,693 | B2 * | 7/2012 | Tsuji | F24F 1/0007 454/322 |
| 8,393,550 | B2 | 3/2013 | Simon et al. | |
| 8,511,108 | B2 * | 8/2013 | Yabu | F24F 1/0011 165/53 |
| 8,715,047 | B2 * | 5/2014 | Kim | F24F 1/0007 454/248 |
| 8,740,101 | B2 | 6/2014 | Leen et al. | |
| 8,746,583 | B2 | 6/2014 | Simon et al. | |
| 9,410,714 | B2 | 8/2016 | Tsuji | |
| 9,574,781 | B2 | 2/2017 | Tsuji | |
| 2001/0054493 | A1 | 12/2001 | Hatanaka | |
| 2003/0157883 | A1 | 8/2003 | Kwak | |
| 2004/0166797 | A1 | 8/2004 | Thrasher et al. | |
| 2005/0053465 | A1 | 3/2005 | Roach et al. | |
| 2005/0109047 | A1 | 5/2005 | Park et al. | |
| 2007/0066215 | A1 | 3/2007 | Song et al. | |
| 2007/0261425 | A1 | 11/2007 | Yasutomi | |
| 2009/0077987 | A1 * | 3/2009 | Egawa | F24F 1/0007 62/259.1 |
| 2009/0199583 | A1 | 8/2009 | Jeon et al. | |
| 2010/0006660 | A1 | 1/2010 | Leen et al. | |
| 2010/0192610 | A1 | 8/2010 | Yoshitake et al. | |
| 2010/0193592 | A1 | 8/2010 | Simon et al. | |
| 2010/0225012 | A1 | 9/2010 | Fitton et al. | |
| 2010/0226801 | A1 | 9/2010 | Gammack | |
| 2010/0287966 | A1 | 11/2010 | Cha | |
| 2011/0048057 | A1 | 3/2011 | Lee et al. | |
| 2011/0137467 | A1 | 6/2011 | Leen et al. | |
| 2011/0319009 | A1 | 12/2011 | Nam | |
| 2012/0003917 | A1 * | 1/2012 | Jeong | F24F 3/16 454/292 |
| 2012/0033952 | A1 | 2/2012 | Wallace et al. | |
| 2012/0214399 | A1 | 8/2012 | Tsuji | |
| 2012/0220212 | A1 | 8/2012 | Tsuji | |
| 2012/0288363 | A1 | 11/2012 | Yumoto et al. | |
| 2013/0186964 | A1 | 7/2013 | Simon et al. | |
| 2013/0280099 | A1 | 10/2013 | Park et al. | |
| 2014/0026604 | A1 | 1/2014 | Yoshimura | |

FOREIGN PATENT DOCUMENTS

| | | | |
|---|---|---|---|
| CN | 1499141 | | 5/2004 |
| CN | 1517613 | | 8/2004 |
| CN | 1573239 | | 2/2005 |
| CN | 1712808 | | 12/2005 |
| CN | 1727764 | | 2/2006 |
| CN | 101464041 | | 6/2009 |
| CN | 201368569 | | 12/2009 |
| CN | 101761986 | | 6/2010 |
| CN | 101796349 | | 8/2010 |
| CN | 102478304 | | 5/2012 |
| CN | 102575869 | | 7/2012 |
| CN | 202630252 | | 12/2012 |
| CN | 1727764 | | 7/2017 |
| EP | 0 884 542 | | 12/1998 |
| EP | 0 926 451 | | 6/1999 |
| EP | 1 003 002 | A2 | 5/2000 |
| EP | 1 152 193 | | 11/2001 |
| EP | 1271065 | A2 | 1/2003 |
| EP | 1 326 055 | A1 | 7/2003 |
| EP | 1 482 252 | A2 | 12/2004 |
| EP | 1 533 577 | A1 | 5/2005 |
| EP | 1 548 375 | A1 | 6/2005 |
| EP | 1 813 875 | A1 | 8/2007 |
| EP | 1 816 406 | A2 | 8/2007 |
| EP | 1 837 607 | A2 | 9/2007 |
| EP | 1 947 397 | A1 | 7/2008 |
| EP | 2 017 542 | A1 | 1/2009 |
| EP | 2023049 | A2 | 2/2009 |
| EP | 2 199 695 | A1 | 6/2010 |
| EP | 2 363 653 | A2 | 9/2011 |
| EP | 2 498 018 | A1 | 9/2012 |
| EP | 2 530 395 | A1 | 12/2012 |
| EP | 3 006 840 | | 4/2016 |
| JP | S58-173320 | A | 10/1983 |
| JP | H11-148698 | A | 6/1999 |
| JP | 2001-173982 | A | 6/2001 |
| JP | 2002-228183 | A | 8/2002 |
| JP | 2003-042515 | | 2/2003 |
| JP | 2003-065558 | A | 3/2003 |
| JP | 2004-138363 | A | 5/2004 |
| JP | 2009-168347 | | 7/2009 |
| JP | 2012-220110 | A | 11/2012 |
| JP | 3183736 | U | 5/2013 |
| KR | 1996-0004920 | | 6/1996 |
| KR | 20-0161129 | | 11/1999 |
| KR | 10-2000-0035591 | A | 6/2000 |
| KR | 10-2005-0083664 | A | 8/2005 |
| KR | 10-0583415 | B1 | 5/2006 |
| KR | 10-2006-0062148 | | 6/2006 |
| KR | 10-2007-0058682 | A | 6/2007 |
| KR | 10-2007-0095141 | | 9/2007 |
| KR | 10-0794596 | B1 | 1/2008 |
| KR | 10-2008-0075632 | A | 8/2008 |
| KR | 10-2007-0080383 | A | 2/2009 |
| KR | 10-2010-0036919 | | 4/2010 |
| KR | 20-2012-0001065 | U | 2/2012 |
| KR | 10-2012-0082934 | A | 7/2012 |
| WO | WO 2004/011854 | A1 | 2/2004 |
| WO | WO 2004/040204 | | 5/2004 |

OTHER PUBLICATIONS

European Search Report issued in Application No. 14185285.5 dated Feb. 4, 2015.

European Search Report issued in Application No. 14187785.2 dated Feb. 4, 2015.

Chinese Office Action dated Nov. 9, 2016 issued in Application No. 201410270547.3 (Translation).

Chinese Office Action dated Nov. 9, 2016 issued in Application No. 201410495092.5 (Translation).

Chinese Office Action dated Oct. 13, 2016.

Korean Office Action dated Aug. 19, 2016 issued in Application No. 10-2013-0117978.

U.S. Office Action dated Oct. 20, 2016 issued in U.S. Appl. No. 14/508,161.

Korean Office Action dated Mar. 7, 2016 issued in Application No. 10-2013-0120944.

Korean Office Action issued in Application No. 10-2013-0117978 dated Feb. 26, 2016.

Korean Office Action issued in Application No. 10-2014-0009419 dated Mar. 2, 2016.

European Search Report issued in Application No. 14188794.3 dated Jun. 24, 2015.

Korean Office Action dated Feb. 2, 2017.

Chinese Office Action dated Feb. 23, 2017 (English Translation).

European Search Report dated Feb. 24, 2015 issued in Application No. 1486801.8.

Korean Office Action dated Feb. 17, 2016 issued in Application No. 10-2013-0117925.

U.S. Office Action issued in U.S. Appl. No. 14/508,161 dated Mar. 16, 2017.

Chinese Office Action dated Nov. 7, 2016.

Korean Office Action dated Jul. 3, 2017.

Chinese Office Action dated Jul. 19, 2007 (English Translation).

(56) References Cited

OTHER PUBLICATIONS

U.S. Office Action issued in U.S. Appl. No. 14/510,599 dated Jun. 30, 2017.
U.S. Office Action issued in U.S. Appl. No. 14/504,823 dated Jul. 25, 2017.
U.S. Office Action issued in U.S. Appl. No. 14/505,190 dated Aug. 2, 2017.
United States Office Action dated Dec. 14, 2017 issued in co-pending U.S. Appl. No. 14/504,823.
U.S. Appl. No. 14/505,190, filed Oct. 2, 2014.
U.S. Appl. No. 14/504,823, filed Oct. 2, 2014.
U.S. Appl. No. 14/508,161, filed Oct. 7, 2014.
U.S. Appl. No. 14/510,599, filed Oct. 9, 2014.
United States Office Action dated Feb. 28, 2018 issued in co-pending related U.S. Appl. No. 14/510,599.

* cited by examiner

RELATED ART

INDOOR DEVICE FOR AIR CONDITIONER HAVING WIND VISORS

CROSS-REFERENCE TO RELATED APPLICATION

The present application claims priority under 35 U.S.C. 119 and 35 U.S.C. 365 to Korean Patent Application No. 10-2014-0009419, filed in Korea on Jan. 27, 2014, which is hereby incorporated by reference in its entirety.

BACKGROUND

1. Field

An indoor device for an air conditioner having wind visors is disclosed herein.

2. Background

In general, air conditioners are cooling/heating systems in which indoor air is suctioned in and heat-exchanged with a low or high-temperature refrigerant, and then the heat-exchanged air is discharged into an indoor space to cool or heat the indoor space. The above-described processes are repeatedly performed. Air conditioners may generate a series of cycles using a compressor, a condenser, an expansion valve, and an evaporator.

In particular, such an air conditioner may include an outdoor unit or device (which is called an "outdoor side" or "heat dissipation side"), which is generally installed in an outdoor space, and an indoor unit or device (which is called an "indoor side" or "heat absorption side"), which is generally installed in a building. The outdoor device may include a condenser, that is, an outdoor heat exchanger, and a compressor, and the indoor device, that is, an indoor heat exchanger, includes an evaporator.

As is well known, air conditioners may be divided into spilt type air conditioners with outdoor and indoor devices, which are installed separately from each other, and integrated type air conditioners with outdoor and indoor devices, which are integrally installed with each other. When considering a space to be installed or noise, the spilt type air conditioner may be preferable.

In a multi type air conditioner of such a spilt type air conditioner, a plurality of indoor devices may be connected to one outdoor device. Thus, as the plurality of indoor devices may be respectively installed in indoor spaces for air-conditioning, an effect as if a plurality of air conditioners are installed may be achieved.

Hereinafter, an indoor device for a cassette type air conditioner in a general multi type air conditioner will be described with reference to the accompanying drawing.

FIG. 1 is a bottom perspective view illustrating an exterior of an indoor device for an air conditioner according to the related art. Referring to FIG. 1, an indoor unit or device 1 for a cassette type air conditioner (hereinafter, referred to as an "indoor device") may have a suction hole 3 defined in a center of a main body 2, and a plurality of discharge holes 4 defined outside the suction hole 3. A blower fan may be provided in the main body 2 to suction air into the suction hole 3 by an operation of the blower fan. The suctioned air may be heat-exchanged in a heat exchanger provided in the main body 2, and then, may be discharged through the plurality of discharge holes 4.

A wind visor 5 is disposed under each of the plurality of discharge holes 4 of the indoor device 1. The wind visor 5 may block a flow of air discharged from the discharge hole 4 to uniformly spread the air discharged from the discharge hole 4 into an indoor space without allowing the air to directly contact a user. The wind visor 5 according to the related art includes a connection part 6 and a wind visor plate 7. A bottom surface of the main body 2 of the indoor device 1 may be connected to the wind visor plate 7 by the connection part 6.

A joint part may be provided on the connection part 6. Thus, the connection part 6 may rotate on the joint part, and the wind visor plate 7 may be inclined at a predetermined angle with respect to a horizontal plane.

However, in the above-described structure, the wind visor 5 may be fixed to the indoor device 1, deteriorating an exterior appearance of the indoor device 1 even though the wind visor 5 is unnecessary. Also, the wind visor 5 can not be installed on an existing indoor device. Thus, to install the wind visor 5, the main body 2 has to be punched and deformed. Thus, if the wind visor 5 is removed because the wind visor 5 is unnecessary, the punched hole may be exposed to the outside, deteriorating the exterior appearance of the indoor device 1. As a result, a separate finishing material may be needed.

Also, in a case of the existing wind visor 5, the connection part 6 should have a joint structure to install. In addition, each of both ends of the connection part 6 should have a structure which is capable of being fixed to the wind visor 5 and the main body 2. Therefore, the indoor device may be complicated in structure.

Also, all surfaces except for a bottom surface between the plurality of discharge holes 4 and the wind visor plate 7 may be open. Thus, wind flowing in a lateral directions may collide with each other in a space between the plurality of discharge holes 4, which are adjacent to each other. As a result, the air may not smoothly flow, and also, noise may occur.

Also, in a case of the connection part 6 to which the wind visor 5 is rotatably connected, although the connection part 6 is rotatable, a separate fixing structure is not provided. Thus, if various situations, such as a case in which the connection part 6 is used for a predetermined time or more, wind strength is strong, or the connection part 6 collides with the wind visor 5 due to carelessness, occur, a rotation angle may be changed. As a result, it may be difficult to guide discharged air to a desired angle.

BRIEF DESCRIPTION OF THE DRAWINGS

Embodiments will be described in detail with reference to the following drawings in which like reference numerals refer to like elements, and wherein.

DETAILED DESCRIPTION

Reference will now be made in detail to embodiments, examples of which are illustrated in the accompanying drawings. The embodiments may, however, be embodied in many different forms and should not be construed as being limited to the embodiments set forth herein; rather, alternate embodiments included in other retrogressive inventions or falling within the spirit and scope will fully convey the concept to those skilled in the art.

Figure 1:
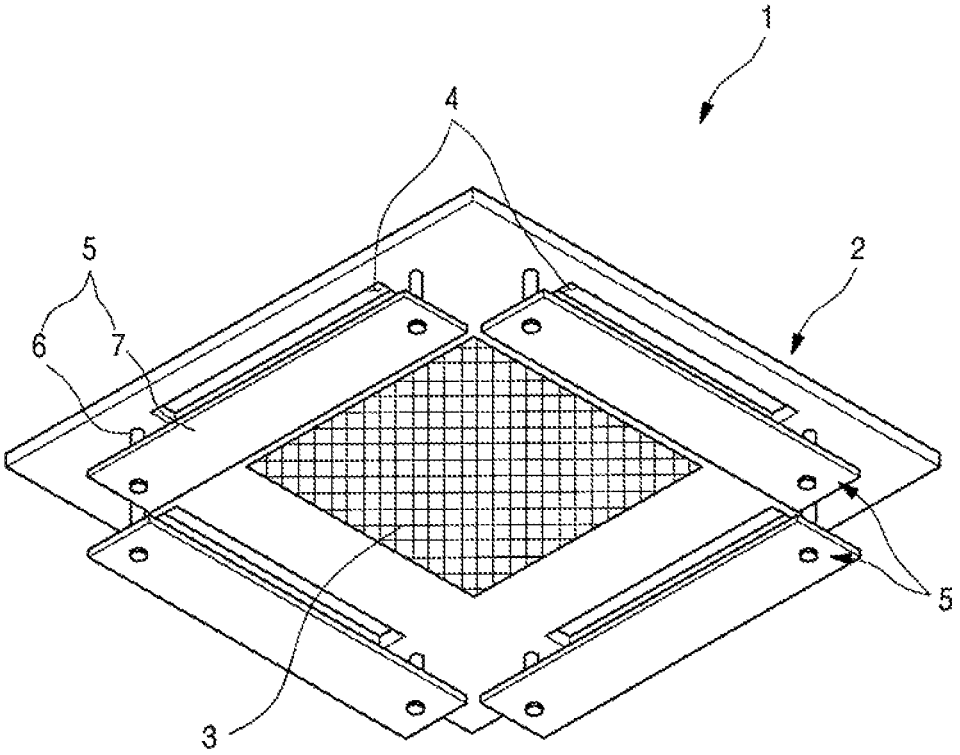
FIG. 1 is a bottom perspective view illustrating an exterior of an indoor device for an air conditioner according to the related art.
Figure 2:
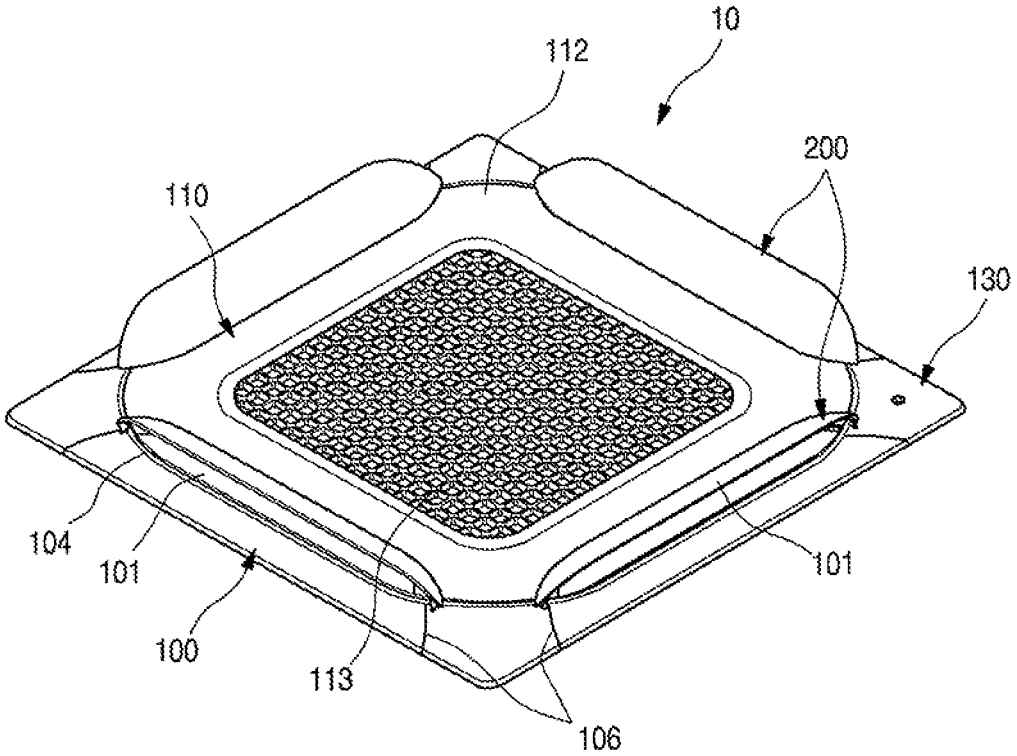
FIG. 2 is a bottom perspective view of an indoor device for an air conditioner having wind visors according to an embodiment.
Figure 3:
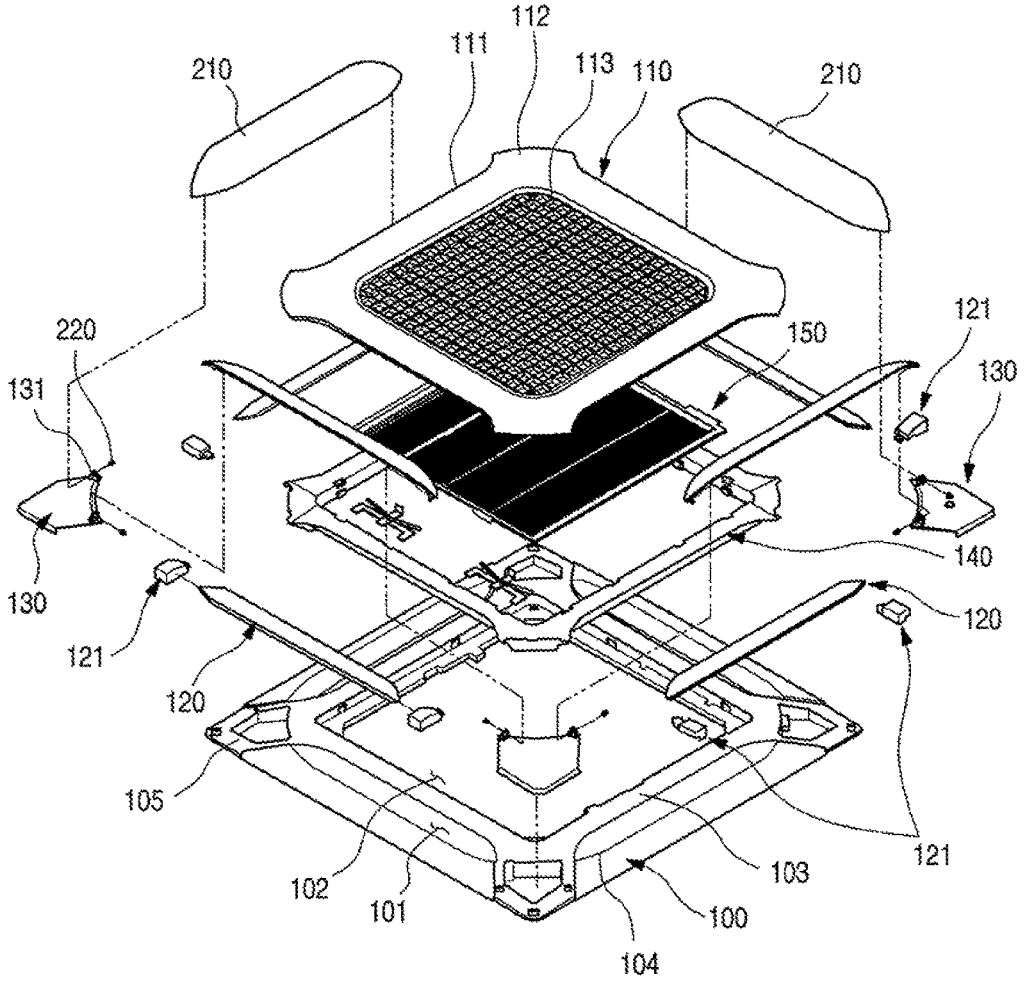
FIG. 3 is an exploded perspective view of the indoor device of FIG. 2.

FIG. 2 is a bottom perspective view of an indoor device for an air conditioner having wind visors according to an embodiment. FIG. 3 is an exploded perspective view of the indoor device of FIG. 2.

Referring to FIG. 2, an indoor unit or device 10 for an air conditioner (hereinafter, referred to as an "indoor device") according to this embodiment may include a cabinet (not shown) inserted into a ceiling in an indoor space, and a panel 100 and suction grill 110, which may be disposed on a lower end of the cabinet to define an exterior of a bottom surface of the indoor device 10 and exposed at a lower side of the ceiling when the indoor device 10 is installed. Although not shown in detail, a heat exchanger that heat-exchanges with suctioned air and a blower fan to forcibly suction and discharge indoor air may be provided in the cabinet.

The panel 100 may be mounted on or at a lower end of the cabinet and have an approximately rectangular shape when viewed from a lower side. The panel 100 may protrude outward from the lower end of the cabinet so that a circumferential portion of the panel is in contact with a bottom surface of the ceiling.

At least one discharge hole 101 to discharge heat-exchanged air flowing inside of the cabinet may be provided in the panel 100. A discharge hole 101 may be defined at a position corresponding to each side of the panel 100. Each discharge hole 101 may be defined along a lengthwise direction of each side of the panel 100. In addition, each discharge hole 101 may each be opened or closed by a vane 120 mounted on the panel 100.

As stated above, the panel 100 may have an approximately rectangular plate shape. A suction hole 102 may be provided in a central portion of the panel 200. Indoor air may be suctioned in through the suction hole 102. The suction hole 102 may have a square shape and a size slightly less than a size of the suction grill 110.

The discharge hole(s) 101 may be defined outside of or adjacent to the suction hole 102. The discharge hole(s) 101 may be provided extending along each of four sides of the suction hole 102. Ends of each discharge hole 101 may have a curve shape having a width that gradually decreases in an outward direction or toward ends thereof.

A grill seat 103 may be disposed outside of the suction hole 102. The grill seat 103 may be stepped to support the suction grill 110. A circumference of the grill seat 103 may have a closed loop shape that generally defines an outer line of the discharge hole(s) 101.

A rounded groove 104 may be defined around the grill seat 103 in a state in which the suction grill 110 is mounted. The rounded groove 104 may have a square shape having four rounded edges. Each of the four rounded edges of the rounded groove 104 may define a line corresponding to an outer line of a protrusion 112 of the suction grill 110 so that vane(s) 120 of the discharge hole(s) 101, the suction grill 110, and the panel 100 may provide a sense of unity. Also, the rounded groove 104 may have a predetermined rounded or inclined section so that discharged air does not flow along the panel 100, thereby preventing the ceiling from being wetted or contaminated by the air discharged from the discharge hole(s) 101.

The discharge hole(s) 101 may be opened or closed by the vane(s) 120. A motor assembly 121 may be disposed on an end at both side ends of the vane 120. Thus, the vane 120 may be rotated by the motor assembly 121 to open or close the discharge hole 101 or adjust a flow direction of discharged air.

Each vane 120 may have a shape corresponding to a shape of a respective discharge hole 101 to cover the discharge hole 101. Also, ends of the vane 120 may have a width that gradually decreases in an outward direction, like the discharge hole 101. When the vane 120 is closed, an outer edge of the vane 120 may extend along the rounded groove 104 to contact the panel 100, and an inner edge of the vane 120 may contact a concave portion 111 of the suction grill 110.

A cover mount 105, on which a corner cover 130 may be mounted, may be disposed on each of four edges of the panel 100. The cover mount 105 may be stepped in a downward direction. When the corner cover 130 is mounted, a top surface (when viewed in FIG. 2) of the corner cover 130 and top surfaces of the panel 100 and the suction grill 100 may be flush with each other to provide a sense of unity.

Also, although not shown in detail, a structure to couple the cover may be further provided between the cover mount 105 and the corner cover 130. That is, structures, such as a rib and slot, which have shapes corresponding to each other, may be provided so that the corner cover 130 may be detachably disposed on the panel 100, and the corner cover 130 may be slidably inserted. In addition, after the corner cover 130 is slidably inserted, one side of the corner cover 130 may be engaged and hooked in a hook shape.

An inspection hole may be provided in each of the four edges of the panel 100. The inspection hole may provide a space to fix and install the panel 100. The inspection hole may be opened or closed by the corner cover 130 so as to receive service to electric components mounted on a back surface of the panel 100 or confirm an operation of the indoor device 10. The inspection hole and the corner cover 130 may be disposed on all of the four edges of the panel 100, or may be disposed on at least one of the four edges.

An end of the corner cover 130 may be disposed to face an end of the protrusion 112 of the suction grill 110 with respect to a boundary of the rounded groove 104. The corner cover 130 and the protrusion 112 may have lines corresponding to the rounded groove 104 to provide a sensor of unity.

A separate panel bracket 140 may be mounted on the grill seat 103 of the panel 100. The panel bracket 140 may be configured to reinforce the grill seat 103 and stably support components to mount or open and close the suction grill 110 mounted on the grill seat 103. Alternatively, the panel bracket 140 may not be provided, but rather, the grill seat 103 and the panel bracket 140 may be integrated with each other to allow the grill seat 103 to perform the function of the panel bracket 140.

The suction grill 110 may be mounted on the grill seat 103. In a state in which the suction grill 110 is mounted, a bottom surface of the panel 100 and a bottom surface of the suction grill 110 may be disposed on a same plane to provide a sense of unity.

The concave portion 111 may be defined in each side of the suction grill 110. The concave portion 111 may be disposed at a same position as an inner line of the discharge hole 101. Also, in the state in which the suction grill 110 is mounted, an inner line of the discharge hole 101 and the concave portion 111 may have a same shape. That is, the concave portion 111 may have rounded ends or edges. The concave portion 110 may have a curvature corresponding to shapes of the discharge hole 101 and the vane 120.

Thus, if the suction grill 110 is closed, an inner line of the vane 120 and the end or edges of the suction grill 110 may be adjacent to each other at a same distance. Thus, the suction grill 110 and the panel 100 may provide a sense of unity.

A protrusion 112 may be disposed on each of the four edges of the suction grill 110. The protrusions 112 may further protrude from the concave portions 111 to define a region between the concave portions 111. Each protrusion 112 may be disposed between adjacent discharge holes 101 when the suction grill 110 is mounted. Each protrusion 112 may have an end that is rounded at a same curvature as that of the rounded groove 104. Thus, in the state in which the suction grill 110 is mounted, a circumference defined by the suction grill 110 and the vane(s) 120 may have a same shape as the rounded groove 104.

Each protrusion 112 may have a same width as the respective corner cover 130. Side grooves 106 defined along each protrusion 112 may extend up to the end or edges of the panel 100 along both sides of the corner cover 130. Also, the side grooves 106 may be connected to the concave portion 111 of the suction grill 110 and the inner line of the vane 120.

Thus, in a state in which the indoor device 10 is installed, when viewed from a lower side of the indoor device 10, the rounded groove 104 may be defined in a center, and the side grooves 106 may be defined in each of four sides. Also, shapes of the suction grill 110, the discharge hole(s) 101, and the vane(s) 120 may be defined by the rounded groove 104 and the side grooves 106.

A structure to fix and selectively restrict movement of the suction grill 110 may be provided on an end of the suction grill 110. Thus, the suction grill 110 may be opened when service to the inside of the indoor device 10 and filter exchange are required.

A filter assembly 150 to purify air may be disposed on an upper surface of the suction grill 110. An air filter to filter foreign substances and physically and chemically purify air may be disposed in the filter assembly 150. The air filter or the filter assembly 150 may be separated, and then, may be replaced after a predetermined time or usable time has elapsed.

A suction portion 113, which may have a lattice shape may be disposed on or at a center of the suction grill 110. The suction portion 113 may be disposed inside the suction hole 102 of the panel 100 to allow the suctioned air to fully flow into the cabinet through the panel 100.

A wind visor 200 may be disposed on or adjacent to each of the discharge holes 101. The wind visor 200 may guide the discharged air in a lateral direction so that the air discharged from the discharge hole 101 is not directly transferred to a user, that is a lower side in the indoor space. The wind visor 200 may be disposed at a position corresponding to each of the discharge hole(s) 101 and may have a shape corresponding to or shape of the discharge hole 101.

Hereinafter, the wind visor according to embodiments will be described in detail with reference to the accompanying drawings.

Figure 4:
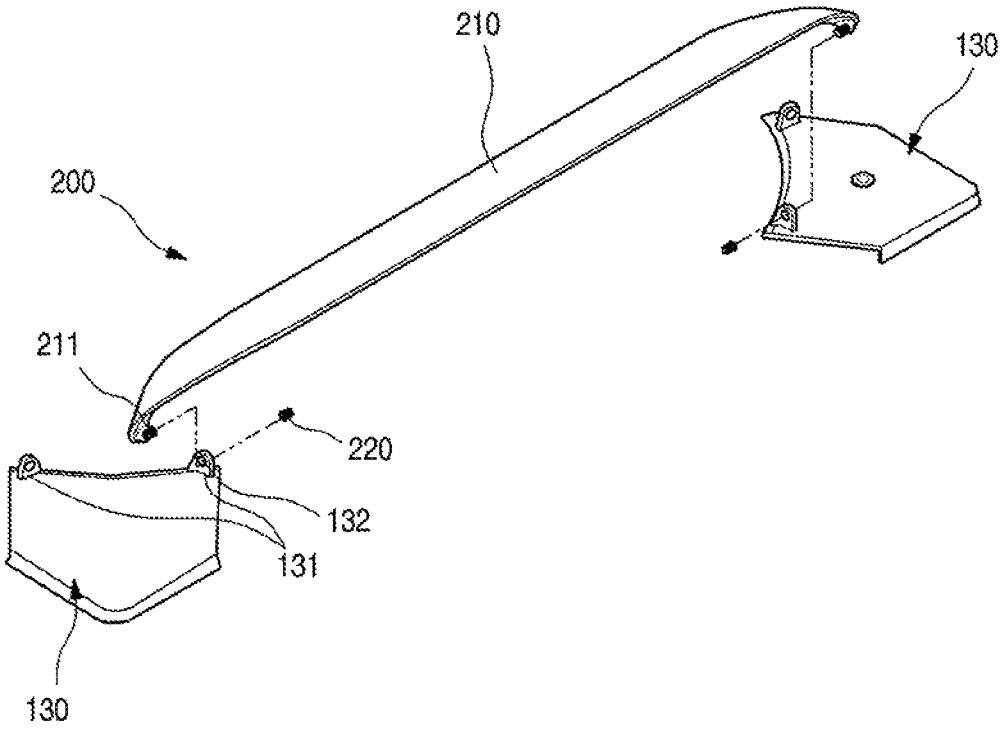
FIG. 4 is an exploded perspective view of a wind visor of the indoor device of FIG. 2.
Figure 5:
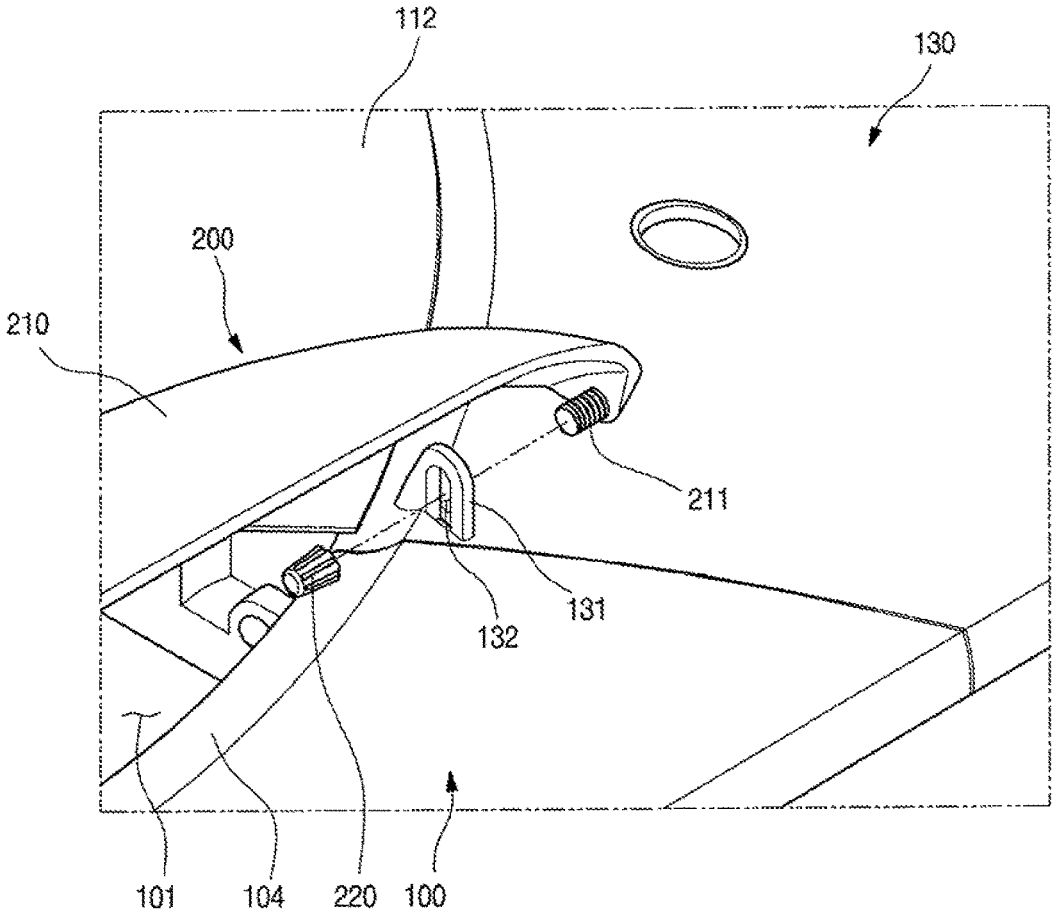
FIGS. 5 and 6 are partial perspective views of a coupling structure of the wind visor of FIG. 4.
Figure 6:
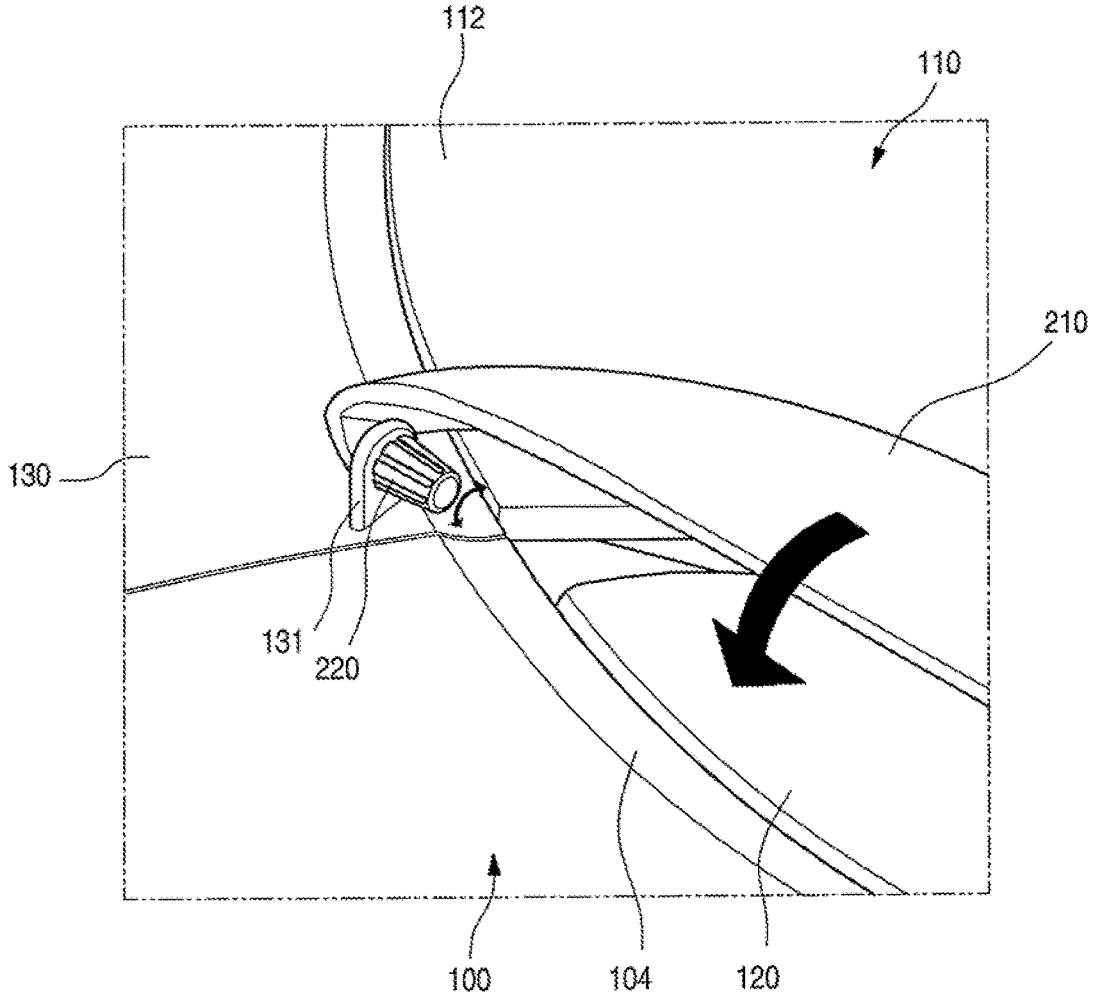

FIG. 4 is an exploded perspective view of a wind visor of the indoor device of FIG. 2. FIGS. 5 and 6 are partial perspective views of a coupling structure of the wind visor of FIG. 4.

As illustrated in the drawings, each wind visor 200 may extend in a shape corresponding to a length in a transverse or lateral direction of the discharge hole 101. Also, the wind visor 200 may have both left and right or lateral ends that have a width gradually decreasing in a lateral direction.

The wind visor 200 may have a rounded cross-section. Both left and right or lateral ends of the wind visor 200 may be rounded inward. Thus, the air discharged from the discharge hole 101 may flow along an inner surface of the wind visor 200, and then, may be smoothly discharged in the lateral direction. More particularly, the air discharged from both left and right or lateral ends of the discharge hole 101 may be discharged into the wind visor 200 along a curvature of the wind visor 200.

As described above, the wind visor may be disposed on or adjacent to each of the discharge holes 101. Thus, the air discharged from the discharge hole 101 may be discharged in the lateral direction without interfering with the wind visor 200.

Also, in a state in which the wind visor 200 is mounted, an outer end of the wind visor 200 may extend along an inner line of the discharge hole 101, that is, the concave portion 111. Also, a lower end of the wind visor 200 may be disposed outside of an outer end of the rounded groove 104 to stably guide the discharged air in the lateral direction.

The wind visor 200 may include a guide plate 210 to guide a flow of air, and a fixing portion 131 to fix the guide plate 210 to the corner cover 130. The guide plate 210 may be rotatably mounted on the fixing portion 131. Then, according to a user's requirement, the guide plate 210 may rotate using the fixing portion 131 as an axis to adjust a discharge angle of the air guided by the wind visor 200.

The guide plate 210 may be injection-molded using a plastic material and have a plate shape, for example. Also, a coupling portion 211 inserted into the fixing portion 131 may be further disposed on each of both ends of the guide plate 210.

The coupling portion 211 may have a bolt shape, for example. The coupling portion 211 may pass through the fixing portion 131 from outside of the fixing portion 131 to extend from each of both ends of the guide plate 210 in directions facing each other. A screw thread may be formed on an outer surface of the coupling portion 211. The coupling portion 211 may be coupled to a cap 220, which may be coupled inside the fixing portion 131 to fix the wind visor 200.

The coupling portion 211 may be injection-molded together with the guide plate 210 using the plastic material when the guide plate 210 is molded. A metal bolt may be insert-injected to form the coupling portion 211 when the guide plate 210 is molded. Alternatively, the coupling portion 211 may be provided as a separate bolt. The bolt may pass through an end of the guide plate 210 and the fixing portion 131 from outside of the guide plate 210 to couple the guide plate 210 to the fixing portion 131.

The fixing, portion 131 may be disposed on the corner covers 130 corresponding to each of both ends of the guide plate 210. The fixing portion 131 may extend in an upward direction from the corner cover 130 and have a coupling hole, through which the coupling portion 211 may pass.

The fixing portion 131 may be integrated with the corner cover 130 by the injection process when the corner cover 130 is molded. Thus, the fixing portion 131 may be molded when the corner cover 130 is molded without performing a separate coupling or mounting process. The fixing portion 131 may be coupled to the guide plate 210 to constitute the wind visor 200.

The wind visor 200 may rotate using the coupling portion 211 as an axis. Thus, the cap 220 may be coupled to the coupling portion 211 at an angle desired by a user to adjust an angle of the wind visor 200.

If the wind visor 200 is unnecessary, the corner cover 130 may be removed. Thus, when a corner cover 130, on which the fixing portion 131 is not provided, is mounted on the panel 100, the exterior of the indoor device 10 may not be deteriorated.

Also, when the wind visor 200 is separated or removed, or mounted, the coupling portion 211 and the cap 220 may be removed from or coupled to each other to complete the removal and coupling process. Thus, the wind visor 200 may be easily removed or mounted.

Hereinafter, operations of the indoor device for an air conditioner having the above-described structure will be described with reference to the accompanying drawings.

Figure 7:
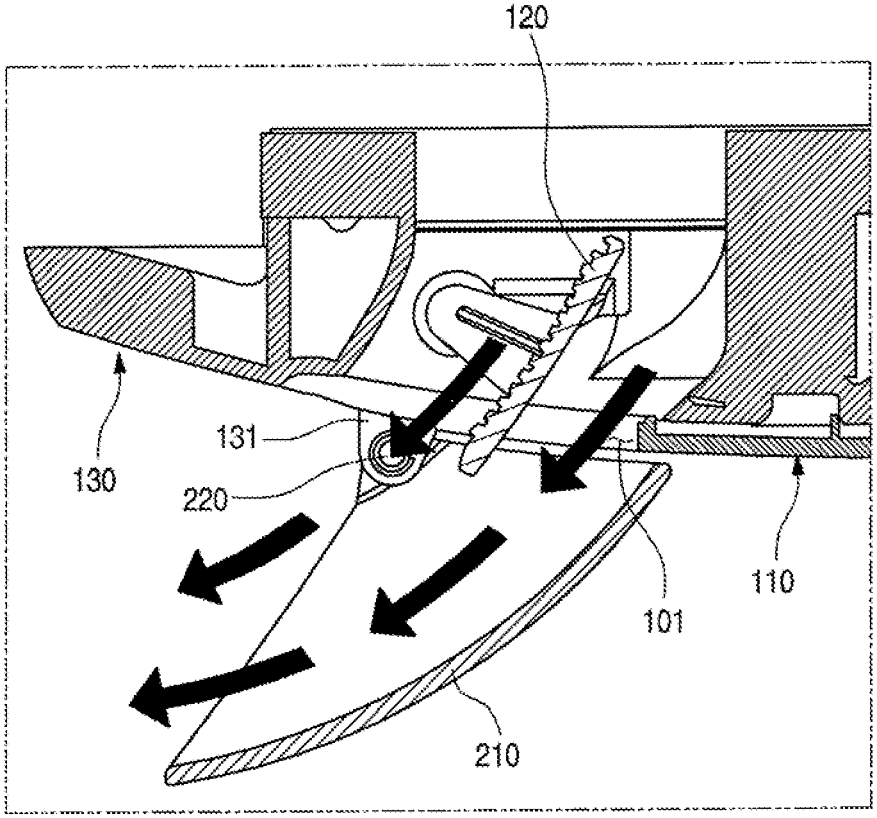
FIG. 7 is a partial cross-sectional view illustrating air flow in the indoor device on which the wind visor is mounted according to embodiments.

FIG. 7 is a partial cross-sectional view illustrating air flow in the indoor device on which the wind visor is mounted according to embodiments. As illustrated in the drawings, when the indoor device 10 operates, indoor air may be suctioned into the indoor device 10 through the suction grill 110. The air may be heat-exchanged within the indoor device 10, and then, may be discharged to the outside through the plurality of discharge holes 101

When the vanes 120 disposed inside the discharge holes 101 rotate, the discharged air may be directed to flow in a flow direction according to a rotating direction of the vane 120. Thus, the air may be discharged in an outward direction from each of the discharge holes 101.

An outer line of the discharge holes 101 may be defined by the rounded groove 104. The rounded groove 104 may have a rounded section. Thus, the discharged air may not flow along an outer surface of the panel 100, but rather, may be discharged into the indoor space. Thus, the discharged air may be supplied into the indoor space without contaminating the panel 100 outside of the discharge holes 101 or a surface of the ceiling.

Ends of each discharge hole 101 of the panel 100 may gradually decrease in width in an outward direction and be rounded to form a tapered end. The guide plate 210, which may define an inner surface of the discharge hole 101, may be disposed with an incline. More particularly, in a case of both ends of the discharge hole 101, the guide plate 210 may be rounded toward both ends of the discharge hole 101. Thus, the discharged air may concentrate a flow of air discharged from ends of the discharge hole 110 in a central direction to prevent dew from being formed on the ends of the discharge hole 101 and ends of the vane 120.

The air discharged through the discharge hole 101 may be guided by the wind visor 200, and thus, may be discharged in a lateral direction. That is, the air discharged through the discharge hole 101 may flow along a curvature of an inner surface of the guide plate 210 of the wind visor 200, and thus, may be discharged through the open side.

The guide plate 210 may also have both left and right or lateral ends having a width gradually decreasing in the outward direction, like the discharge hole 101. Thus, the discharged air may be discharged toward lateral sides of the guide plate 210, that is, may not be discharged toward the outside of the guide plate 210, but rather, may be discharged toward the inside of the guide plate 210. Thus, the air discharged through each discharge hole 101, which may be defined in four directions, may not collide or interfere with each other, but rather, may be discharged in four directions.

Also, as the guide plate 210 may contact an inner line of the discharge hole 101, the air discharged through the discharge hole 101 may be discharged in the outward direction. Thus, the air discharged through the discharge hole 101 may not interrupt a flow of air suctioned through the suction gill 110, and also, may not be introduced again through the suction grill 110.

The wind visor 200 may be manipulated to adjust a discharge angle of discharged air. The guide plate 210 may be rotated using the coupling portion 211 as an axis. After the guide plate 210 rotates to a preset or predetermined angle, the guide plate 210 may be coupled to the cap 220, and thus, may be fixed. Thus, when the indoor device 10 operates, direct contact between the discharged air and a user may be prevented.

Also, if the wind visor 200 is unnecessary, the cap 220 may be separated, and then, the guide plate 210 may be separated or removed through a simple process. Also, if the wind visor 200 is not used for a long time, or the wind visor 200 is not used at all, a corner cover 130 on which the fixing portion 131 is not provided may be mounted to realize an elegant exterior of the indoor device 10.

The indoor device for an air conditioner including wind visors according to embodiments may be identically applied to various embodiments in addition to the embodiment discussed above.

An indoor device for an air conditioner including wind visors according to another embodiment is characterized in that each wind visor may include a guide plate and a fixing portion disposed on a panel.

The indoor device for an air conditioner including wind visors according to this embodiment is the same as the previous embodiment except for components of the wind visor and corner cover. Thus, like reference numeral have been used to indicate like elements, and repetitive detailed description has been omitted.

Figure 8:
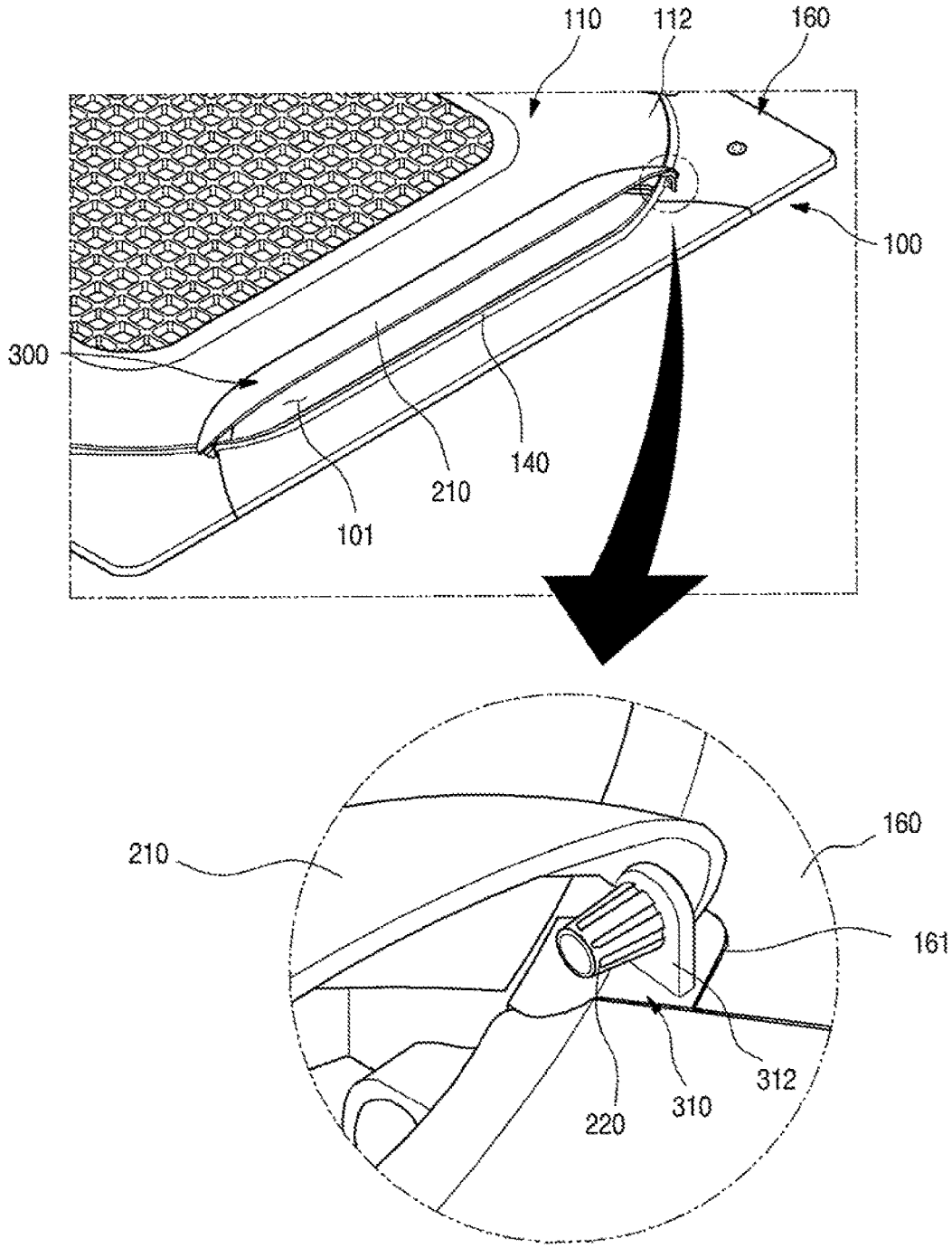
FIG. 8 is a partial perspective view of a portion on which a wind visor is mounted according to another embodiment.
Figure 9:
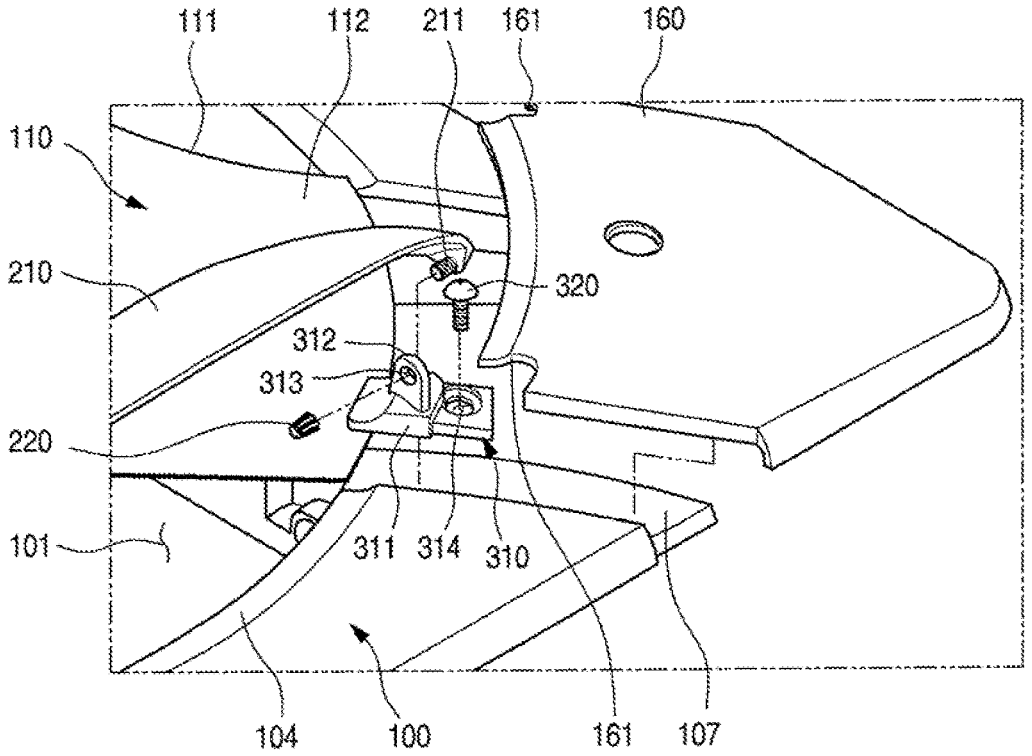
FIG. 9 is a partial exploded perspective view illustrating a coupling structure of the wind visor of FIG. 8.

FIG. 8 is a partial perspective view of a portion on which a wind visor is mounted according to another embodiment. FIG. 9 is a partial exploded perspective view illustrating a coupling structure of the wind visor of FIG. 8.

As illustrated in the drawings, indoor device 10 according to this embodiment may include a cabinet, in which a blower fan and a heat exchanger may be accommodated, panel 100 disposed on a lower end of the cabinet and exposed in a ceiling in an indoor space to define an exterior of a bottom surface of the indoor device 10, and a suction grill 110 disposed in or at a center of the panel 100.

A suction hole (see reference numeral 102 in FIG. 3) covered by the suction grill 110 and through which air may be suctioned in when the blower fan operates, and discharge holes 101 defined along four directions that cross each other along or outside of the suction hole 102 may be defined in the panel 100.

Each discharge hole 101 may extend in a direction corresponding to each side of the panel 100. Both sides of each discharge hole 101 may extend in a longitudinal direction, having a width that gradually decreases in an outward direction. Thus, the discharge hole 101 may have tapered ends.

Rounded groove 104 may be defined in the panel 100. A portion of the rounded groove 104 may be defined in a corner cover 160 mounted on or at an edge of the panel 100. Thus, when the corner cover 160 is mounted, the rounded groove 104 may have a closed loop shape.

Concave portion 111 recessed in a shape corresponding to an inner line of each discharge hole 101 may be defined in each of or edges sides of the suction grill 110, and protrusion 112 may be disposed on each of four edges of the suction grill 110. Thus, the suction grill 110 may be mounted and define a portion of each discharge hole 101.

A cover mount 107, on which the corner cover 160 may be mounted, may be disposed on each of four edges of the panel 100. The cover mount 107 may be stepped in a downward direction. When the corner cover 160 is mounted, a top surface (when viewed in FIG. 8) of the corner cover 160 and top surfaces of the panel 100 and the suction grill 100 may be flush with each other to provide a sense of unity.

A coupling structure to couple the corner cover 160 may be provided between the cover mount 107 and the corner cover 160. Thus, the corner cover 160 may be detachably coupled to the panel 100. The corner cover 160 may be coupled using, for example, a rib and slot, which have shapes corresponding to each other, so that the corner cover 160 may be slidably inserted. In addition, after the corner cover 160 is slidably inserted, one side of the corner cover 160 may be engaged and hooked in a hook shape. A fixing portion 310, which may be one component of the wind visor 300 and will be described hereinbelow, may be mounted on the cover mount 107. The corner cover 160 may have a space in which the fixing portion 310 mounted on the cover mount 107 may be mounted.

Thus, when the corner cover 160 is mounted, at least a portion of the fixing portion 310 may protrude in an outward direction from the corner cover 160 and be exposed to the outside. A cutoff portion 161 and the fixing portion 310 may be engaged with each other to prevent a gap from occurring between the cutoff portion 161 and the fixing portion 310. Also, in a state in which the fixing portion 310 is mounted, guide plate 210, which is one component of the wind visor 300, may be rotatably mounted on the fixing portion 310.

The wind visor 300 may guide air discharged from the discharge hole 101 to the outside. The wind visor 300 may include the guide plate 210 to guide a direction of wind, and the fixing portion 310 to fix and mount the guide plate 210.

In detail, the guide plate 210 may guide the air discharged from the discharge hole 101 in a lateral direction. That is, the guide plate 210 may have the same structure as the guide plate 210 described above with respect to the previous embodiment.

That is, the guide plate 210 may have a shape corresponding to a shape of the discharge hole 101, and both lateral ends of the guide plate 210 may be sharply rounded. Also, when the guide plate 210 is mounted, both lateral ends of the guide plate 210 may be rounded in a direction of the panel 100.

Thus, the coupling portion 211, which may protrude in an inward direction from each of both lateral ends of the guide plate 210, may pass through the fixing portion 310, and then, may be mounted. The coupling portion 211 may have a same structure and shape as that described with respect to the previous embodiment, and also, the coupling portion 211 may be integrated with the guide plate 210. Alternatively, the coupling portion 211 may be provided as a separate member, and then, may be coupled to the guide plate 210.

The fixing portion 310 may be provided as a separate member. In this case, the fixing portion 310 may be mounted on one side of the panel 100 corresponding to the coupling portion 211 of the guide plate 210. That is, the fixing portion 310 may be mounted on the cover mount 107 by a separate member, such as screw 320, for example.

In more detail, the fixing portion 310 may be stepped and closely attached and fixed to one end of the cover mount 107. The fixing portion 310 may include a coupling portion 311 that contacts the cover mount 107, a coupling piece 312 that protrudes in an upward direction, and a coupling hole 313 to allow the coupling portion 211 to pass therethrough.

A coupling hole 314 may be further defined in the coupling portion 311. The screw 320 passing through the coupling hole 314 may be coupled to the panel to fix the fixing portion 310. Also, the coupling portion 211 may be coupled to the cap 220 in a state in which the coupling portion 211 passes through the coupling hole 313 to fix the guide plate 210 on the fixing portion 310.

The corner cover 160 may be mounted on the cover mount 107 after the guide plate 210 is coupled to the fixing portion 310. The corner cover 160 may be slidably inserted and engaged and hooked with one side of the cover mount 107.

Also, in a state in which the corner cover 160 is completely mounted on the cover mount 107, the cutoff portion 161 may be defined on one side of the corner cover 160 corresponding to the fixing portion 310. The cutoff portion 161 may allow the coupling piece 312 of the fixing portion 319 to protrude in the upward direction. That is, an end of the cutoff portion 161 may be recessed in an inward direction.

Thus, in a state in which the corner cover 160 is completely mounted, the coupling piece 312 may protrude in the upward direction through the cutoff portion 161 and be coupled to the coupling portion 211. Alternatively, if the wind visor is unnecessary, the wind visor 300 may be separated or removed and stored. Also, if the wind visor 200 is not used for a long time, or the wind visor 200 is not used at all, the fixing portion 310 may be removed from the panel 100, and then, a general corner cover 130, which does not have the cutoff portion 161, may be mounted.

The indoor device for an air conditioner including wind visors according to this embodiment may be identically applied to various embodiments in addition to the previous embodiments.

An indoor device for an air conditioner including wind visors according to still another embodiment is characterized in that the wind visor may include a guide plate and a fixing portion disposed on a panel or corner cover, and an end of the guide plate may be rotatably inserted into the fixing portion.

The indoor device for an air conditioner including wind visors according to this embodiment may be the same as the previous embodiments except for components of the wind visor. Thus, like reference numerals have been used to refer to like elements, and repetitive detailed descriptions has been omitted.

Figure 10:
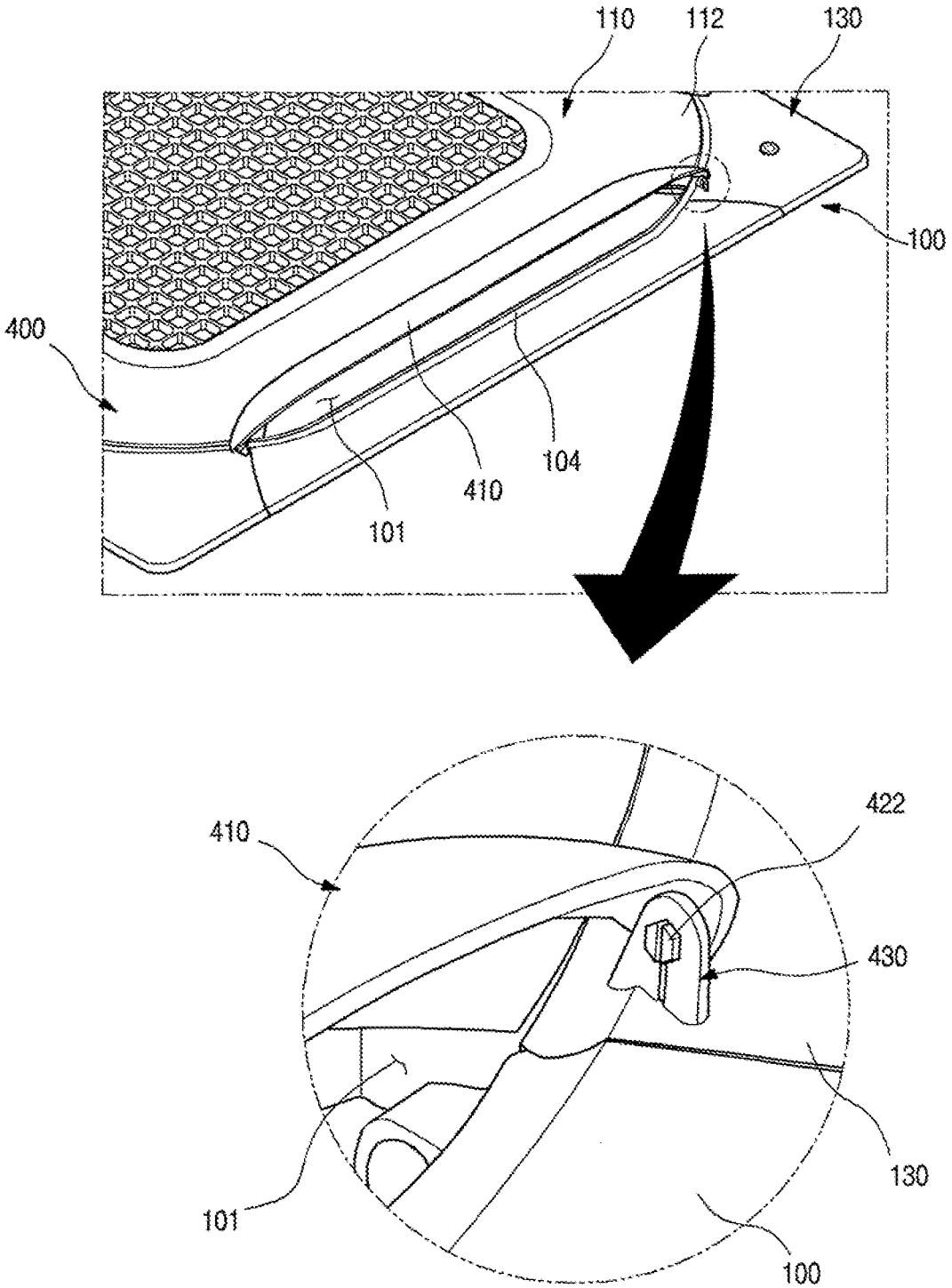
FIG. 10 is a partial perspective view of a portion on which a wind visor is mounted according to still another embodiment.
Figure 11:
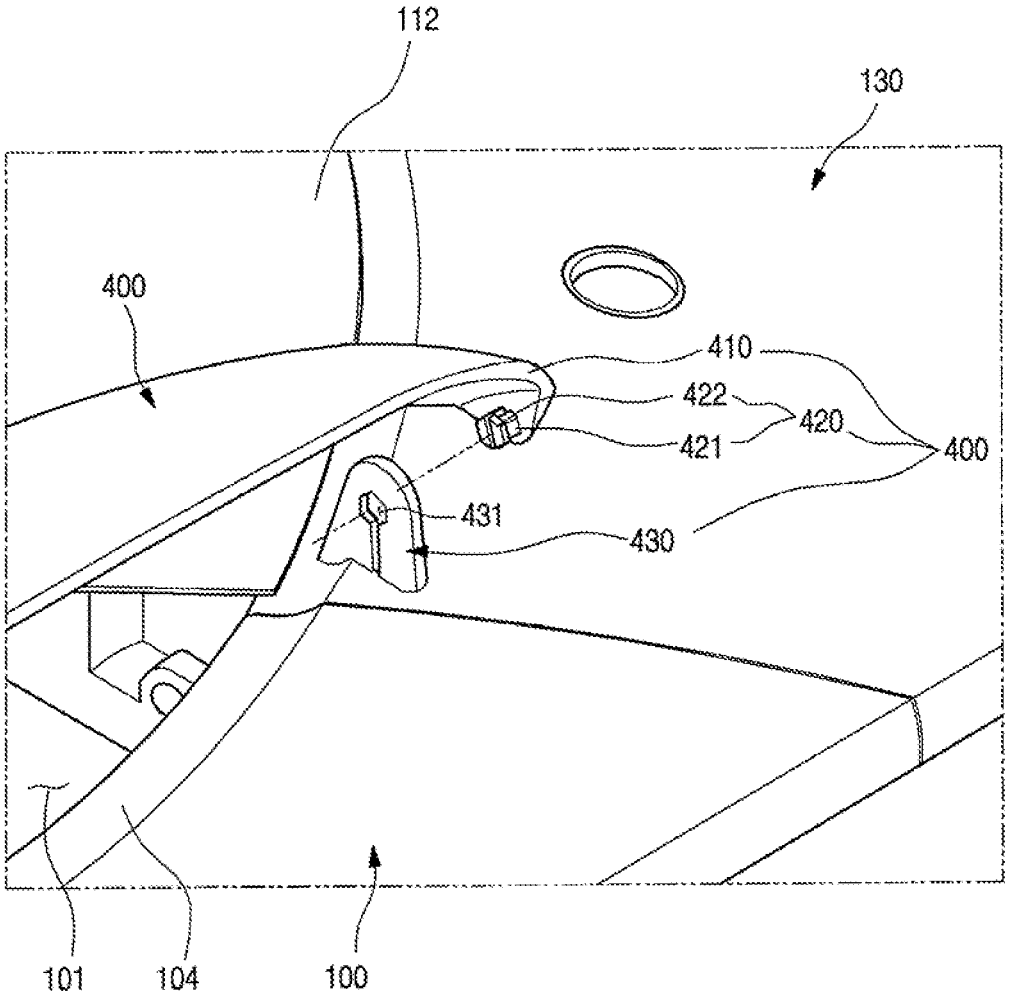
FIG. 11 is a partial exploded perspective view illustrating a coupling structure of the wind visor of FIG. 10.

FIG. 10 is a partial perspective view of a portion on which a wind visor is mounted according to still another embodiment. FIG. 11 is a partial exploded perspective view illustrating a coupling structure of the wind visor of FIG. 10.

As illustrated in the drawings, wind visor 400 may be mounted indoor device 10 according to this embodiment. The wind visor 400 may include a guide plate 410 having a plate shape to guide air, and a fixing portion 430 rotatably coupled to each of both ends of the guide plate 410.

In more detail, the guide plate 410 may have a length and shape that correspond to those of discharge hole 101. That is, the guide plate 410 may have a width that gradually decreases toward both lateral ends thereof, and both lateral ends of the guide plate 410 may be tapered. Also, both lateral ends of the guide plate 410 may be rounded toward the discharge hole 101. That is, a cross-section of the guide plate 410 may be rounded to guide air discharged from the discharge hole 101 in a lateral direction.

A coupling portion 420 may be disposed on each of both lateral ends of the guide plate 410. The coupling portion 420 may be coupled to a fixing portion 430 disposed on the panel 100 or the corner cover 130. The coupling portion 420 may be provided as protrusions that protrudes from both lateral ends of the guide plate 410 in directions facing each other.

In more detail, the coupling portion 420 may include an extension portion 421 that extends from an end of the guide plate 410 and a hook 422 that protrudes outward from an end of the extension 421. A plurality of planes may be defined around the extension 421. Thus, in a state in which the coupling portion 420 is inserted into the fixing portion 423, the guide plate 410 may rotate in stages at an angle corresponding to an angle between planes adjacent to each other.

Also, the hook 422 may further protrude in an outward direction from the coupling portion 420 and have an inclined circumference so that the hook 422 may be easily inserted into the fixing portion 430. In a state in which the coupling portion 420 is inserted, the hook 422 may be hooked with the fixing portion 430 to prevent the guide plate 410 from being separated therefrom.

Also, the coupling portion 420 may have a shape in which the coupling portion 420 is divided in both directions with respect to a center thereof. Both sides may be spaced apart from each other, and thus, may be elastically deformed when the coupling portion 420 is inserted into the fixing portion 430.

The fixing portion 430 may have a plate shape that extends upward from the panel 100 or corner cover 130 that corresponds to the coupling portion 420. The fixing portion 430 may be integrated with the panel 100 or separately provided with respect to the panel 100 according to the structure of the indoor device 10. Also, the fixing portion 430 may be integrated with the corner cover 130.

A fixing hole 431, in which the coupling portion 420 may be inserted, may be defined in the fixing portion 430. The fixing hole 431 may have a polygonal shape to correspond to a shape of a circumference of the extension 421 of the coupling portion 420. Also, the fixing hole 431 may have a size less than a size of the hook 422. After the coupling portion 420 passes through and is inserted into the fixing hole 431, the hook 422 may be hooked with the fixing portion 430 to prevent the guide plate 410 from being separated therefrom.

Thus, when the coupling portion 420 passes through the fixing portion 430, a plane around the extension 421 and an inner surface of the fixing portion 430 may contact each other and be engaged with each other to maintain a fixed state of the guide plate 410. Also, when the guide plate 410 rotates to adjust an angle thereof, the extension 421 may rotate inside of the fixing portion 431. The extension 421 may rotate at an angle corresponding to an angle between the planes adjacent to each other and then be fixed to the inside of the fixing hole 431.

When the coupling portion 420 passes through and is inserted into the fixing hole 431, both sides of the coupling portion 420 may be elastically deformed to allow the hook 422 to pass through the fixing hole 431. After the hook 422 passes through the fixing hole 431, the hook 422 may be hooked with the fixing hole 431, and an outer surface of the extension 421 may contact an inner surface of the fixing hole 431 to maintain the fixed state of the guide plate 410.

The indoor device for an air conditioner including wind visors according to this embodiment may be identically applied to various embodiments in addition to the previous embodiments.

An indoor device for an air conditioner including wind visors according to still another embodiment is characterized in that the wind visor may include a guide plate and a connection member to rotatably connect the guide plate to a panel or corner cover.

The indoor device for an air conditioner including wind visors according to this embodiment may be the same as the previous embodiments except for components of the wind visor. Thus, like reference numeral have been used to indicate like elements, and repetitive detailed descriptions has been omitted.

Figure 12:
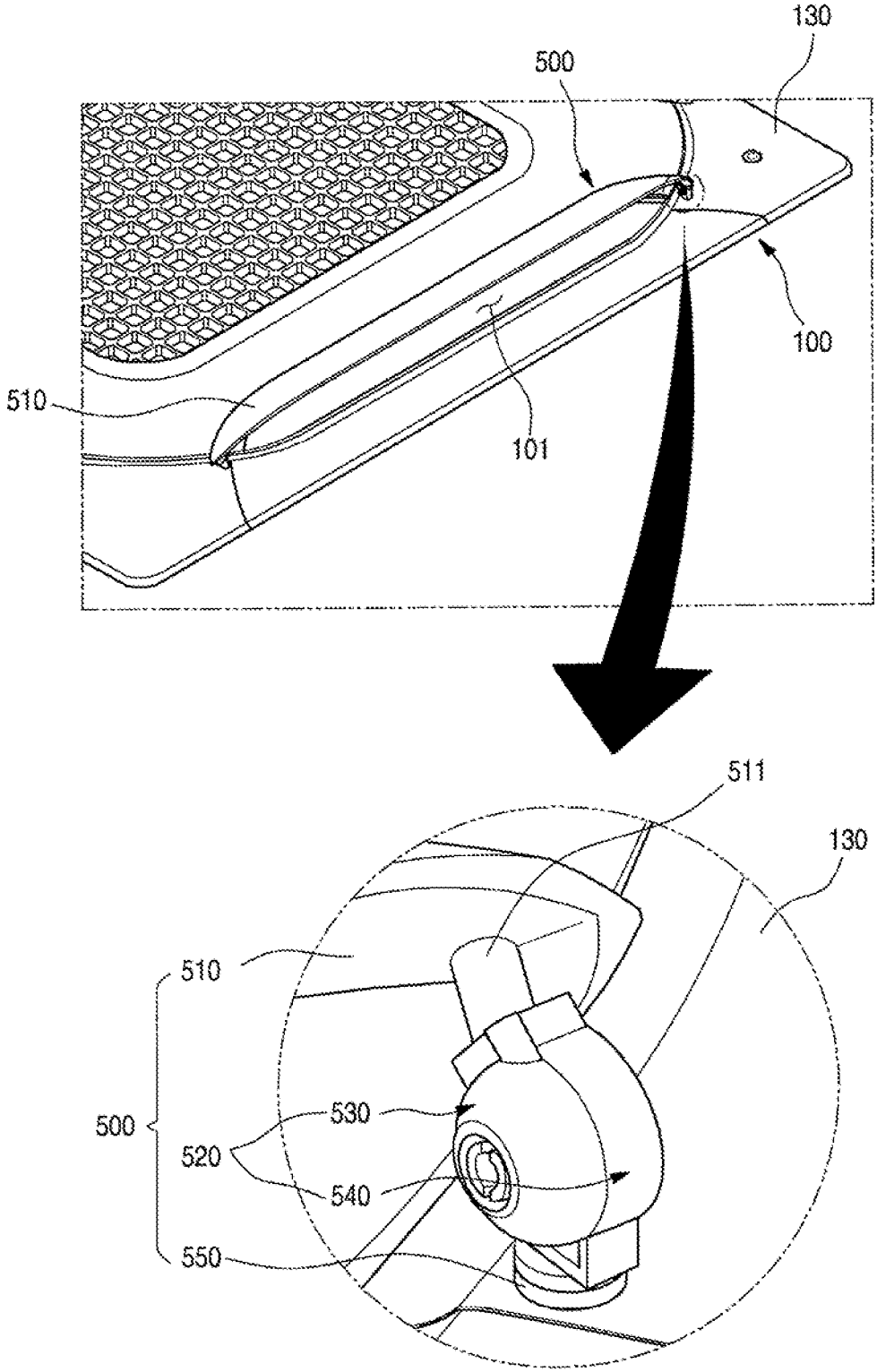
FIG. 12 is a partial perspective view of a portion on which a wind visor is mounted according to still another embodiment.
Figure 13:
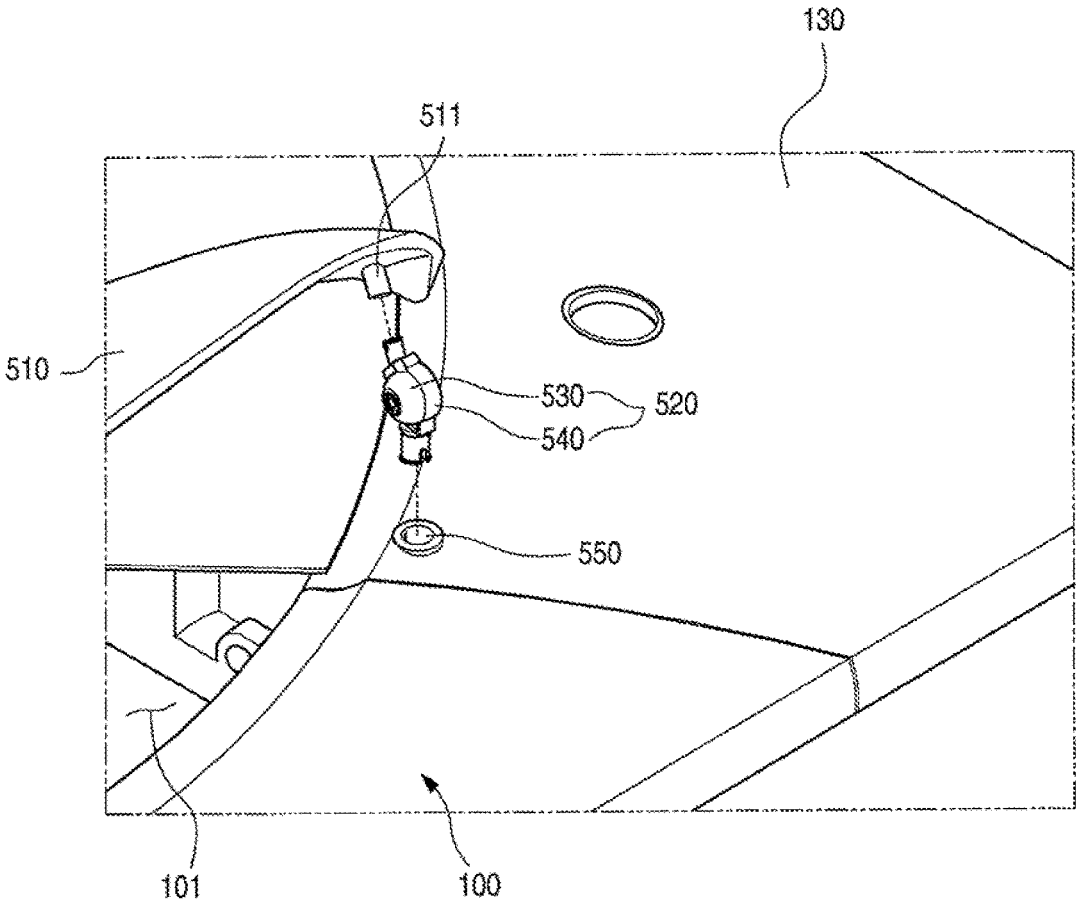
FIG. 13 is a partial exploded perspective view illustrating a coupling structure of the wind visor of FIG. 12.

FIG. 12 is a partial perspective view of a portion on which a wind visor is mounted according to still another embodiment. FIG. 13 is a partial exploded perspective view illustrating a coupling structure of the wind visor of FIG. 12.

As illustrated in the drawings, wind visor 500 may be mounted on indoor device 10 according to this embodiment. The wind visor 500 may include a guide plate 510 to guide air discharged from discharge hole 101, a connection member 520 that connects the guide plate 510 to the indoor device 10 so that the guide plate 510 may be rotatably mounted on the indoor device 10, and a fixing portion 550 to fix the connection member 520 to corner cover 130.

In more detail, the guide plate 510 may have a length and shape that correspond to those of discharge hole 101. That is, the guide plate 510 may have a width that gradually decreases toward both lateral ends thereof, and both lateral ends of the guide plate 510 may be tapered. Also, both lateral ends of the guide plate 510 may be rounded toward the discharge hole 101. That is, a cross-section of the guide plate 510 may be rounded to guide air discharged from the discharge hole 101 in a lateral direction.

A mount 511 may be disposed on each of both lateral ends of the guide plate 510. The mount 511 may be opened so that one end of the connection member 520 may be inserted therein.

The connection member 520 may include a first connection member 530 and a second connection member 540, which may be shaft-coupled to each other to be rotatable. A first mount protrusion 532 (see FIG. 14) that extends from an upper end of the first connection member 530 may be inserted into the mount 511, and a second mount protrusion 542 that extends from a lower end of the second connection member 540 may be inserted into the fixing portion 550 disposed on the corner cover 130.

Thus, in a state in which the connection member 520 is assembled and then mounted on the guide plate 510 and the corner cover 130, a mounted state of the guide plate 510 may be maintained. The guide plate 510 may be rotatably mounted by the connection member 520.

Figure 14:
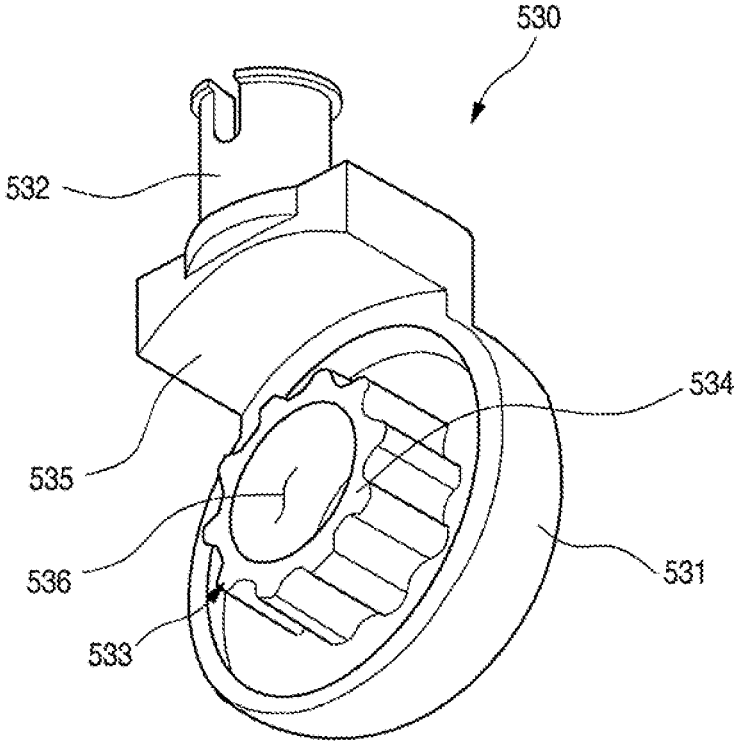
FIGS. 14 and 15 are view of fi and second connection members of the wind visor of FIG. 12.
Figure 15:
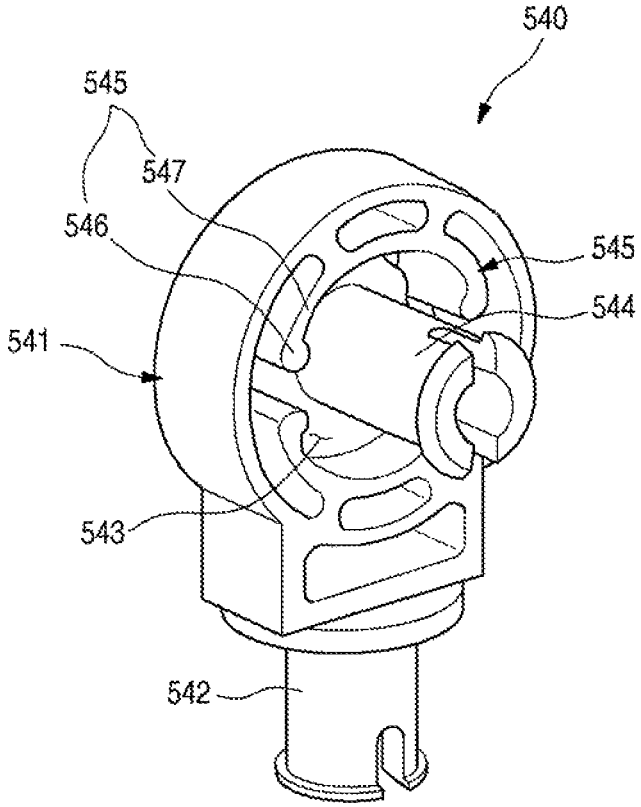
Figure 16:
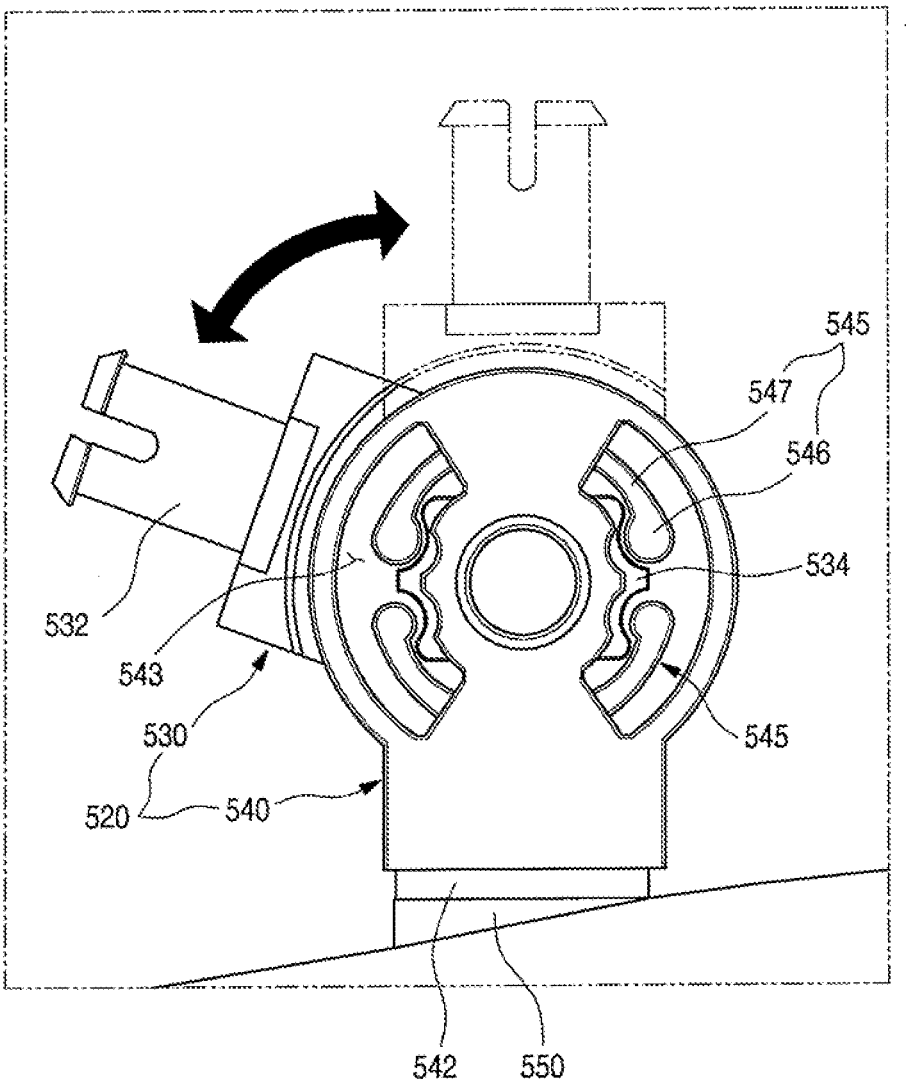
FIG. 16 is a view illustrating an operation state of the connection member of the wind visor of FIG. 12.

FIGS. 14 and 15 are views of first and second connection members of the wind visor of FIG. 12. FIG. 16 is a view illustrating an operation state of the connection member.

A structure of the connection member 520 will be described in more detail with reference to FIGS. 14 to 16. The connection member 520 may include the first connection member 530, illustrated in FIG. 14, and the second connection member 540, illustrated in FIG. 15, which may be coupled to each other. The first and second connection members 530 and 540 may be rotatable in a state in which the first and second connection members 530 and 540 are coupled to each other.

The first connection member 530 may be fixedly mounted on the guide plate 510. The first mount protrusion 532 inserted into the mount 511 of the guide plate 510 may extend in an upward direction from an upper end of the first connection member 530. A first body 531 may be disposed under the first mount protrusion 532. The first body 531 may have a circular shape. The first body 531 may form a portion of an exterior in a state in which the first body 531 is coupled to the second connection member 540.

A rotation portion 533 may protrude from a center of the first body 531. The rotation portion 533 may serve as a rotational shaft of the connection member 520. The rotation portion 533 may protrude from one side of the first body 531, and then, may be coupled to the second connection member 540. A tooth portion 534 may be disposed along a circumference of the rotation portion 533. The tooth portion 534 may be selectively hooked with a restricter 545, which will be described hereinbelow.

A connection portion 535 may be disposed between the first mount protrusion 532 and the first body 531. The first mount protrusion 532 may be disposed on a top surface of the connection portion 535, and the first body 531 may be disposed on one end of the connection portion 535. Thus, in a state in which the first and second connection members 530 and 540 are coupled to each other, the connection portion 535 may be disposed above the second connection member 540. The first and second mount protrusions 532 and 542 may be disposed on a same extension line.

The second connection member 540 may be fixedly mounted on the corner cover 130. A second mount protrusion 542 inserted into the fixing portion 550 of the corner cover 130 may be disposed on a lower end of the second connection member 540. A second body 541 may be disposed above the second mount protrusion 542.

The second body 541 may have a shape corresponding to a shape of the first body 531. The second body 541 may have an accommodation portion 543, in which the rotation portion 533 of the first body 531 may be accommodated. A rotational shaft 544 that passes through an opening 536 defined in a center of the rotation portion 533 may be disposed on or at a center of the second body 541. Thus, the first connection member 530 may rotate with respect to the rotational shaft 544.

A plurality of restricters 545 may be disposed outside of the accommodation portion 543. The restricters 545 may include a head 546 having a shape corresponding to a shape of the tooth portion 534, and a rib 547 that extends from the head 546. The plurality of restricters 545 may be successively disposed along the accommodation portion 543. The plurality of restricters 545 may be spaced apart from each other. Also, an end of the rib 547 may be fixed, and the rib 547 may have a predetermined elasticity.

Thus, in a state in which the first and second connection members 530 and 540 are coupled to each other, when the first or second connection member 530 or 540 rotates, the tooth portion 534 may rotate, and the restricters 545 may allow the head 546 to be successively inserted into grooves defined in the tooth portion 534 by the elasticity of the rib 547.

That is, when the guide plate 510 rotates to adjust an angle thereof, the first and second connection members 530 and 540 may rotate relatively with respect to each other. The guide plate 510 may rotate at or to a predetermined angle by the coupling of the restricters 545 and the tooth portion 534. Also, the guide plate 510, which is in a rotating state, may be maintained in a fixed state thereof by the coupling of the tooth portion 534 and the restricters 545

The indoor device for an air conditioner including wind visors according to this embodiment may be identically applied to various embodiments in addition to the previous embodiments.

An indoor device for an air conditioner including wind visors according to another embodiment is characterized in that the wind visor may include a guide plate and a connection member to rotatably connect the guide plate to a fixing portion, which may be disposed on a panel or corner cover.

The indoor device for an air conditioner including wind visors according to this embodiment is the same as the previous embodiments except for components of the wind visor. Thus, like reference numeral have been used to indicate like elements, and repetitive detailed descriptions has been omitted.

Figure 17:
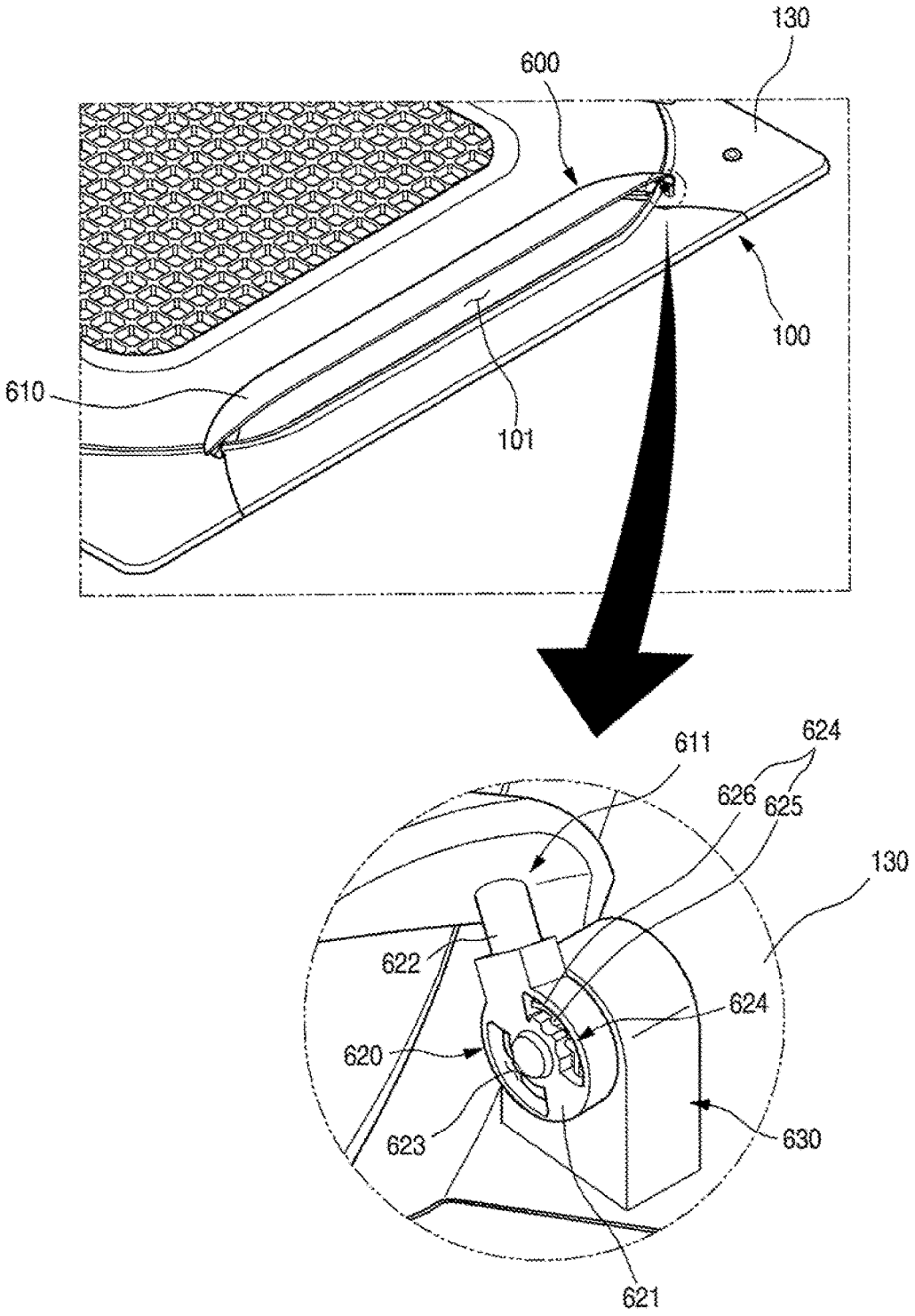
FIG. 17 is a partial perspective view of a portion on which a wind visor is mounted according to another embodiment.
Figure 18:
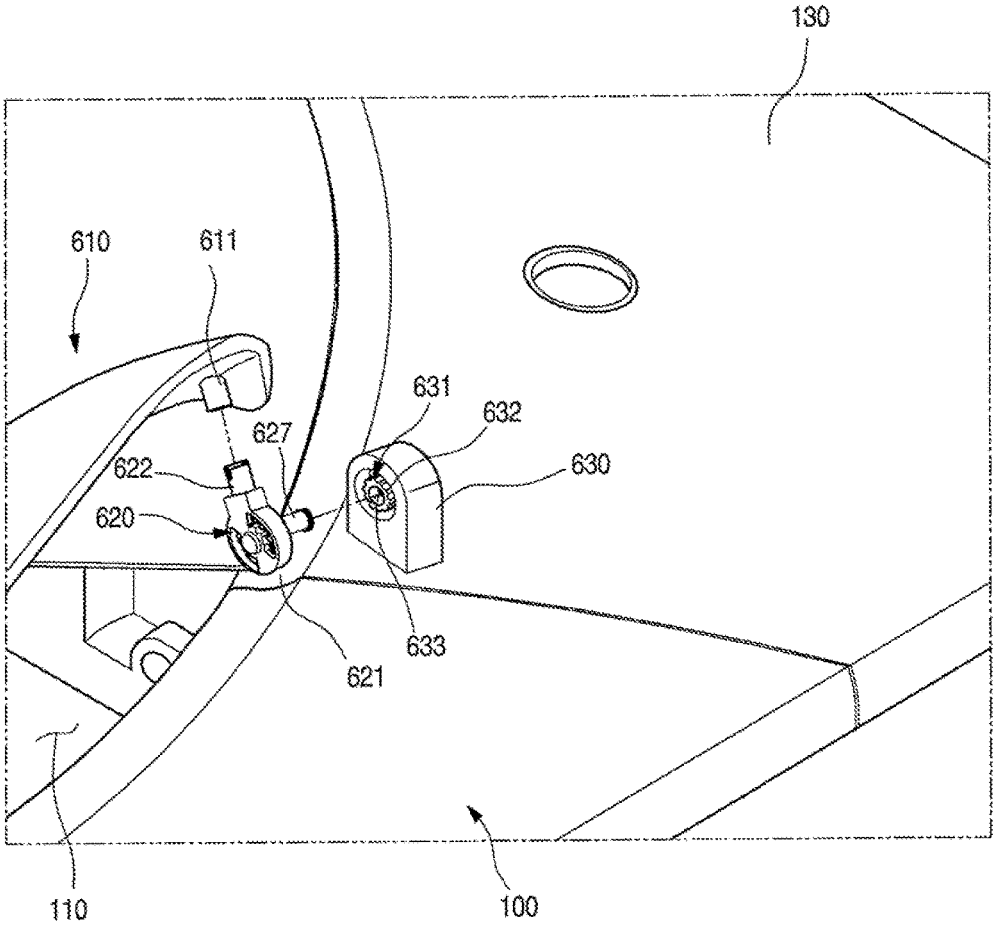
FIG. 18 is a partial exploded perspective view illustrating a coupling structure of the wind visor of FIG. 18.

FIG. 17 is a partial perspective view of a portion on which a wind visor is mounted according to still another embodiment. FIG. 18 is a partial exploded perspective view illustrating a coupling structure of the wind visor of FIG. 18.

As illustrated in the drawings, wind visor 600 may be mounted on indoor device 10 according to this embodiment. The wind visor 600 may include a guide plate 610 to guide air discharged from discharge hole 101, a connection member 620 to connect the guide plate 610 to the indoor device 10 so that the guide plate 610 may be rotatably mounted on the indoor device 10, and a fixing portion 630 to fix the connection member 620 to corner cover 130.

In detail, the guide plate 610 may have a length and shape that correspond to a shape and length of the discharge hole 101. That is, the guide plate 610 may have a width that gradually decreases toward lateral ends thereof, and the lateral ends of the guide plate 610 may be tapered. Also, the lateral ends of the guide plate 610 may be rounded toward the discharge hole 101. That is, a cross-section of the guide plate 610 may be rounded to guide air discharged from the discharge hole 101 in a lateral direction.

A mount 611 may be disposed on each of the lateral ends of the guide plate 610. The mount 611 may be open so that a first end of the connection member 620 may be inserted therein. When the guide plate 610 is molded, the mount 611 may be integrated with the guide plate 610, for example.

The connection member 620 may have the first end inserted into and fixed to the mount 611, and a second end disposed on the corner cover 130 and rotatably mounted on the fixing portion 630. Thus, in a state in which the connection member 620 is mounted on the guide plate 610 and the corner cover 130, a mounted state of the guide plate 610 may be maintained. The guide plate 610 may be rotatably mounted by the connection member 620.

In detail, a mount protrusion 622 inserted into the mount 611 of the guide plate 610 may extend in an upward direction from the connection member 620. The mount protrusion 622 may be disposed on the connection member 620 and may be press-fitted into the mount 611. Thus, the guide plate 610 and the connection member 620 may rotate together with each other.

A body 621 may be disposed under the mount protrusion 622. The body 621 may have a circular shape and be coupled to the fixing portion 630. The mount protrusion 622 may be disposed on an upper end of the body 621, and the body 621 may have one side surface having a shape corresponding to a shape of the fixing portion 630 to be coupled thereto.

In detail, an accommodation portion 623, in which a rotation portion 631 disposed on the fixing portion 630 may be accommodated, may be disposed in one surface of the body 621. A rotational shaft 627 that passes through an opening 633 defined in a center of the rotational portion 631 may be disposed on or at a center of the second body 621. Thus, the connection member 620 may rotate with respect to the rotational shaft 627.

A plurality of restricters 624 may be disposed outside of the accommodation portion 623. The plurality of restricters 624 may include a head 626 having a shape corresponding to a shape of a tooth portion 632 disposed on the fixing portion 630, and a rib 265 that extends from the head 626. The plurality of restricters 624 may be successively disposed along the outside of the accommodation portion 623. The plurality of restricters 624 may be spaced apart from each other. An end of the rib 626 may be fixed, and the rib 547 may have a predetermined elasticity.

Thus, in a state in which the connection member 620 and the fixing portion 630 are coupled to each other, when the connection member 620 rotates, the plurality of restricters 624 may allow the head 265 to continuously pass through grooves defined in the tooth portion 632 to move due to the elasticity of the rib 626. That is, when the guide plate 610 is gripped to rotate, thereby adjusting an angle thereof, the connection member 620 and the fixing portion 630 may rotate relatively with respect to each other. The guide plate 610 may rotate at a predetermined angle by the coupling of the plurality of restricters 624 and the tooth portion 632. Also, the guide plate 610, which is in a rotating state, may be maintained in a fixed state thereof by the coupling of the tooth portion 632 and the plurality of restricters 624.

The fixing portion 630 may be disposed on one side of the corner cover 130 corresponding to each of both ends of the guide plate 610. The fixing portion 630 may be integrated with the corner cover 130. Alternatively, the fixing portion 630 may be provided as a separate member with respect to the corner cover 130, and then, may be disposed on the panel 100.

The fixing portion 630 may extend upward from the corner cover 130, and the rotation portion 631 may protrude from one side of the fixing portion 630. The rotation portion 631 may be inserted into the accommodation portion 623 of the connection member 620, and the tooth portion 632 may be disposed along a circumference of the rotation portion 631. The tooth portion 632 may be disposed along the circumference of the rotation portion 631 so that the tooth portion 632 may be selectively hooked with the plurality of restricters 624 as described.

Thus, when the fixing portion 630 and the connection member 620 are coupled to each other, the rotational shaft 627 may pass through the opening defined in the center of the rotation portion 631, and the rotation portion 631 may be inserted into the accommodation portion 623. The head 265 of the plurality of restricters 624 may be inserted into the groove of the tooth portion 632 so that the guide plate 610 rotates at the predetermined angle.

The indoor device for an air conditioner including wind visors according to this embodiment may be identically applied to various embodiments in addition to the previous embodiments.

An indoor device for an air conditioner including wind visors according to still another embodiment is characterized in that the wind visor may include a guide plate and a rotation portion to rotatably connect the guide plate to a fixing portion, which may be disposed on a panel or corner cover.

The indoor device for an air conditioner including wind visors according to this embodiment is the same as the previous embodiments except for components of the wind visor. Thus, like reference numeral have been used to indicate like elements, and repetitive detailed descriptions has been omitted.

Figure 19:
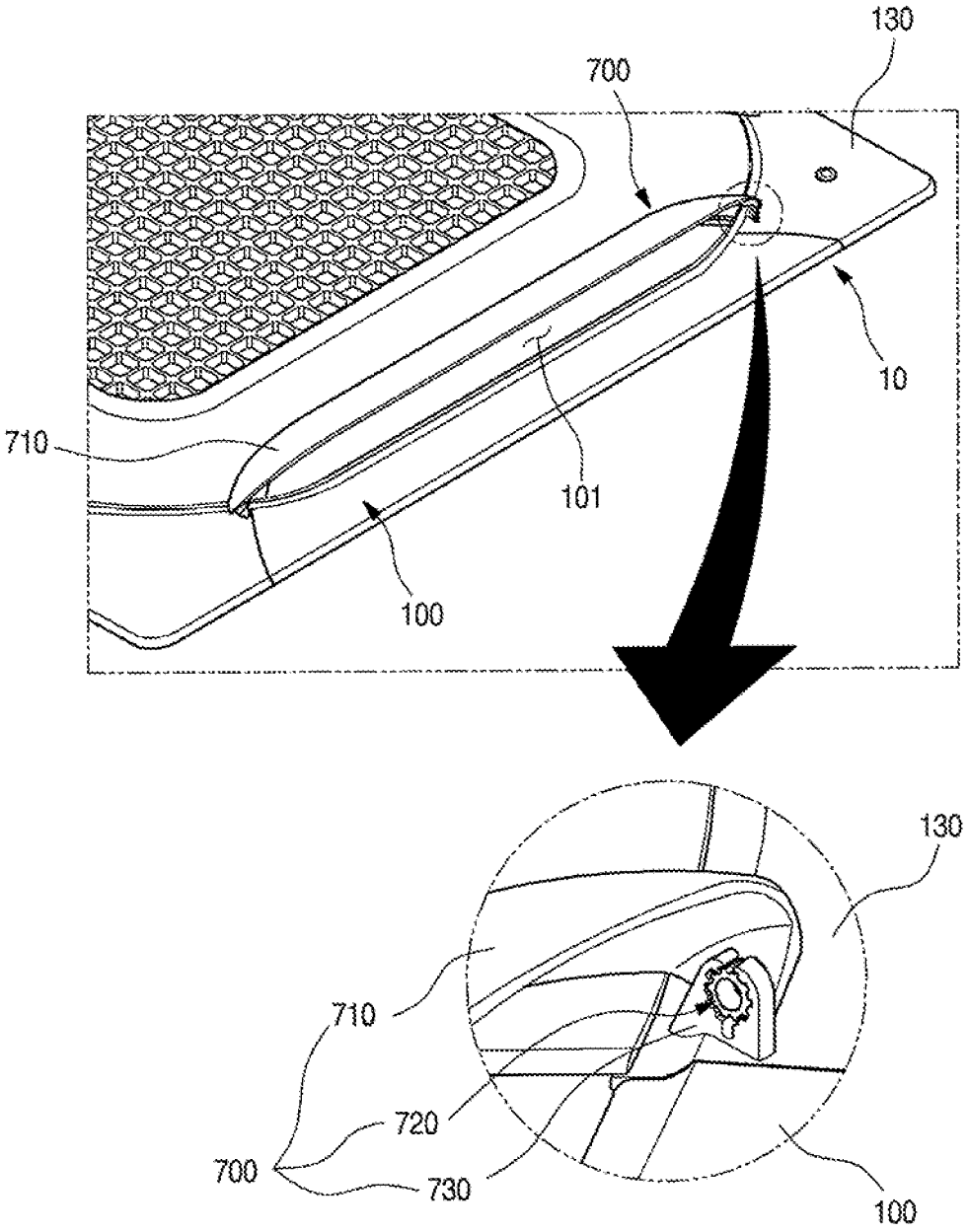
FIG. 19 is a partial perspective view of a portion on which a wind visor is mounted according to still another embodiment.
Figure 20:
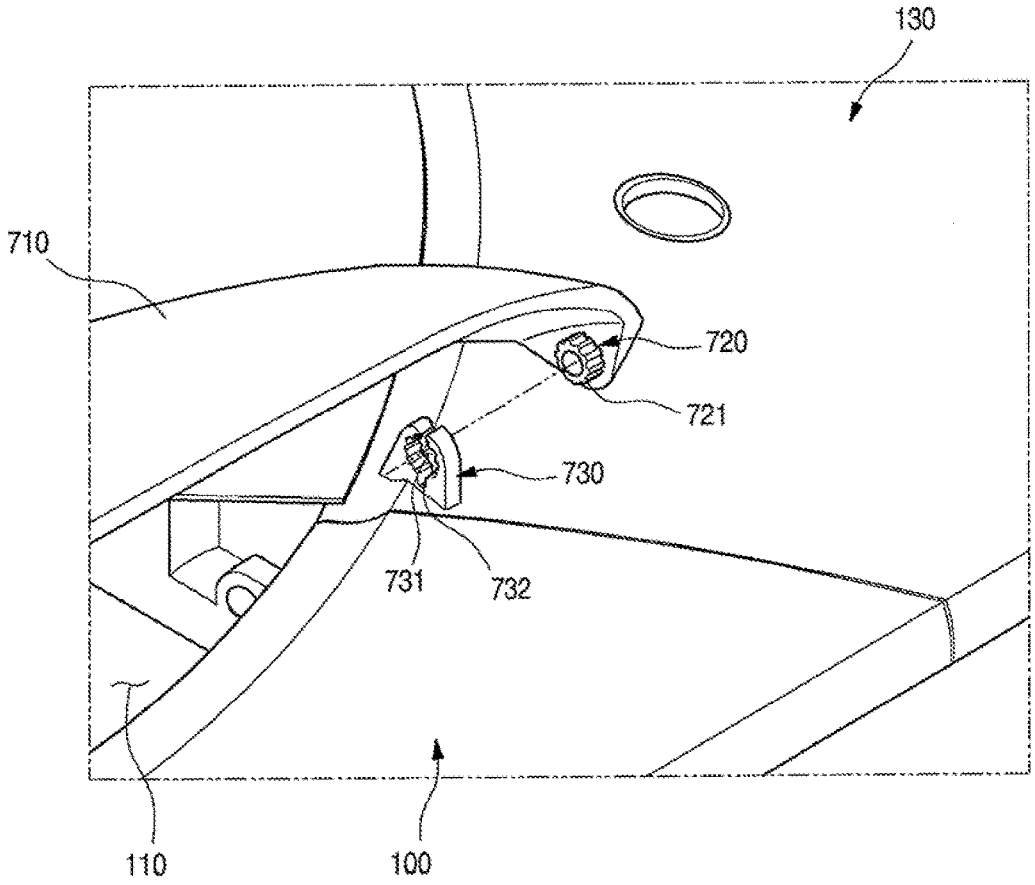
FIG. 20 is a partial exploded perspective view illustrating a coupling structure of the wind visor of FIG. 19.

FIG. 19 is a partial perspective view of a portion on which a wind visor is mounted according to still another embodiment. FIG. 20 is a partial exploded perspective view illustrating a coupling structure of the wind visor of FIG. 19.

As illustrated in the drawings, wind visor 700 may be mounted on indoor device 10 according to this embodiment. The wind visor 700 may include a guide plate 710 to guide air discharged from discharge hole 101, a rotation portion 720 to rotatably mount the guide plate 710 to the indoor device 10, and a fixing portion 730 to fix the rotation portion 720 to corner cover 130. In detail, the guide plate 710 may have a length and shape that correspond to a shape and length of the discharge hole 101. That is, the guide plate 710 may have a width that gradually decreases toward lateral ends thereof, and the lateral ends of the guide plate 710 may be tapered. Also, the lateral ends of the guide plate 710 may be rounded toward the discharge hole 101. That is, a cross-section of the guide plate 710 may be rounded to guide air discharged from the discharge hole 101 in a lateral direction.

The rotation portion 720 may be disposed on each of both lateral ends of the guide plate 710 and may protrude in directions facing each other. The rotation portion 720 may be inserted into the fixing portion 730, which will be described hereinbelow, and teeth 721 may be disposed at a predetermined distance along a circumference of the rotation portion 720.

The fixing portion 730 coupled to the rotation portion 720 may be disposed on the corner cover 130. The fixing portion 730 may be disposed on or at a position corresponding to each of the lateral ends of the guide plate 710 and may be integrated with the corner cover 130. Alternatively, the fixing portion 730 may be disposed on the panel 100 or may be provided as a separate member.

The fixing portion 730 may extend in an upward direction and have an opening 731, in which the rotation portion 720 may be inserted. An upper end of the opening 731 may be open, and a cutoff portion 732 may be disposed on a lower end corresponding to the open upper end. When the rotation portion 720 is inserted and rotates, the fixing portion 730 may be elastically deformed so that the rotation portion 720 may be easily inserted and rotate.

The tooth portion 731 may be disposed around the opening 731 of the fixing portion 730. The tooth portion 731 may have a shape corresponding to the teeth 721 disposed around the rotation portion 720. When the rotation portion 720 is inserted into the opening 731, the tooth portion 731 may be engaged with the teeth 721 disposed around the rotation portion 720.

Thus, when a user manipulates the guide plate 710 to rotate, the tooth portion 731 and the teeth 721 of the rotation portion 720 may be engaged to allow the guide plate 710 to rotate or to at a predetermined angle. Then, when the guide plate 710 completely rotates, a fixed rotating angle of the guide plate 710 may be maintained.

According to embodiments, the guide plate to guide the air discharged from the discharge hole may have both ends, which may be rounded. Thus, the discharged air may not interfere with the air discharged from adjacent discharge holes, to improve air flow.

Also, the fixing portion rotatably coupled to the guide plate may be integrated with the corner cover, which may be detachably disposed. Thus, the guide plate and the fixing portion may be directly coupled without using a separate coupling member, and also may be easily separated from each other, to improve assemblability and productivity.

Also, as the fixing portion may be disposed on the corner cover or mounted on the panel, if the wind visor is unnecessary, only the corner cover may be replaced to realize an elegant exterior. Thus, it may prevent an exterior from being deteriorated due to installation and separation of the wind visor. Also, as only the corner cover is replaced from the existing indoor device to mount the wind visor, the wind visor may be applied to various products.

Also to adjust an angle of the guide plate, the cap may be tightened at a predetermined angle, the coupling portion having the plurality of planes may be provided, or the connection member may have a tooth structure. Thus, the guide plate may rotate at or to a predetermined angle, and then, the rotating angle may be maintained to prevent the guide plate from being changed in angle.

Embodiments disclosed herein provide a wind visor having a more simplified structure having a shape corresponding to a shape of a discharge hole and rotatably directly mounted on a bottom surface of an indoor unit or device to guide discharged air. Embodiments disclosed herein further provide an indoor unit or device for an air conditioner having a wind visor, in which a fixing part or portion to install the wind visor may be provided in the indoor unit, and the wind visor may be rotatably coupled to the fixing part through a simple structure.

Embodiments disclosed herein provide an indoor unit or device for an air conditioner that may include a panel disposed on a lower end of a cabinet in which a heat exchanger and a blower fan may be accommodated and exposed to a ceiling, the panel having a suction hole to suction air and a discharge hole to discharge air; a suction grill that covers the suction hole, the suction grill suctioning in indoor air; and a wind visor mounted on one side of the panel to guide the air discharged from the discharge hole. The wind visor may include a guide plate disposed under the discharge hole and having a rounded inner surface to guide the air discharged from the discharge hole in a lateral direction; and a fixing part or portion disposed on one side of the panel corresponding to each of both ends of the guide plate. The fixing part may be coupled to the guide plate to allow the guide plate to rotate at or to a preset or predetermined angle and be fixed.

The guide plate may extend along an inner line of the discharge hole and be opened to the outside. The discharge hole and the guide plate may have a same length, and each of the discharge hole and the guide plate may have a width that gradually decreases toward both left and right or lateral ends thereof. The guide plate may be rounded toward the panel in a direction of each of both ends of the guide plate.

Coupling parts or portions that extend in directions facing each other and having screw shapes to pass through the fixing part may be disposed at both ends of the guide plate, respectively, and a cap having a screw thread corresponding to an inside of the coupling part and coupled to the coupling part to fix the guide plate at the preset angle may be further disposed on the coupling part. The coupling part may be integrated with the guide plate when the guide plate is molded.

The coupling part may be provided as a separate member and be coupled outside the guide plate. The fixing part may protrude from an outer surface of the panel.

A corner cover that defines an exterior of an edge of the indoor unit may be detachably disposed on an edge of the panel corresponding between a plurality of discharge holes. A cutoff part or cutoff cut to expose at least one portion of the fixing part to the outside may be further disposed on the corner cover.

A corner cover that defines an exterior of an edge of the indoor unit may be detachably disposed on an edge of the panel corresponding between the plurality of discharge holes. The fixing part may be disposed on the corner cover.

A coupling part or portion press-fitted into the fixing part and that protrudes inward to serve as a rotational shaft of the guide plate may be disposed on each of both ends of the guide plate, and a plurality of planes corresponding to each other may be provided on a circumference of the coupling part and an inner surface of the fixing part. A central portion of the coupling part may be cut in a longitudinal direction to pass through the fixing part, or the coupling part may be elastically deformed when the guide plate rotates.

A connection member that connects the fixing part to the guide plate and serves as a rotational shaft of the guide plate may be disposed on each of both ends of the guide plate. The connection member may include a first connection member connected to each of both ends of the guide plate, and a second connection member connected to the fixing part. The first and second connection members may be rotatably coupled to each other.

The first connection member may include a rotational part or portion that protrudes to be inserted into the second connection member and a tooth part or portion disposed around the rotational part, and the second connection member may include a rotational shaft that passes through the rotational part and a restriction part or restricter that contacts an outer surface of the tooth part to selectively restrict relative rotation between the first and second connection members. The connection member may include a mount protrusion coupled to an end of the guide plate; a rotational part or protrusion disposed on a lower portion of the mount protrusion, the rotational part protruding to be inserted into the fixing part; and a teeth disposed around the rotation part.

An opening, in which the rotation part may be accommodated, and a tooth part corresponding to the teeth may be disposed or defined in the fixing part. A center of the opening may be cut and elastically deformed when the rotation part rotates.

The discharge hole may be defined in each of four sides of the panel. The discharge hole may have a width that gradually decreases outward.

The wind visor may contact the panel along an inner line of the discharge hole and be opened outward.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims, in addition to variations and modifications in the component parts and/or arrangements, alternative uses will also be apparent to those skilled in the art.

What is claimed is:

1. An indoor device for an air conditioner, the indoor device comprising:

a panel disposed on a lower end of a cabinet in which a heat exchanger and a blower fan are accommodated and exposed through a ceiling, the panel having a centrally located suction hole formed inside a grill seat and a discharge hole formed beyond the periphery of the grill seat;

a suction grill installed at the grill seat and covering the suction hole, the suction grill having a concave portion formed to correspond to an inner line edge of the discharge hole;

a vane which is formed in a shape corresponding to a shape of the discharge hole, mounted interior of the discharge hole, and configured to rotate to open or close the discharge hole; and a wind visor disposed under the vane and exterior to the discharge hole to guide the air which is discharged passing through the vane from the discharge hole, wherein the wind visor comprises:

a fixing portion disposed on an exterior side of the panel; and a guide plate having a rounded inner surface to guide the air in a lateral direction, the guide plate being detachably connected to the fixing portion such that the guide plate may rotate using the fixing portion as an axis to adjust a discharge angle of the air guided by the wind visor, and wherein the guide plate is positioned to be spaced below the discharge hole, has an upper edge, a lower edge and a curved surface that extends roundly such the profile corresponds to the shape of the concave portion and the upper edge of the guide plate is in contact with and corresponds to the shape of the concave portion and wherein the curved surface of the guide plate tapers such that both the upper edge and the lower edge arc to meet at a rounded point near the fixing portion.

2. The indoor device according to claim 1, wherein the fixing portion is disposed on the one side of the panel corresponding to each of both ends of the guide plate, and wherein the wind visor further comprises:

coupling portions that extend in directions facing each other and having screw shapes to pass through the fixing portion are disposed at the both ends of the guide plate, respectively; and a cap having a screw thread corresponding to an inside of a respective coupling portion of the coupling portions and coupled to the respective coupling portion to fix the guide plate at a predetermined angle.

3. The indoor device according to claim 2, wherein the fixing portion protrudes from an outer surface of the panel.

4. The indoor device according to claim 3, wherein the discharge hole comprises a plurality of discharge holes and the fixing portion comprises a plurality of fixing portions, wherein a corner cover that defines an exterior of each edge of the indoor device is detachably disposed on each edge of the panel between the plurality of discharge holes, and wherein each corner cover includes a cutoff cut to expose at least a portion of a respective fixing portion of the plurality of fixing portions outside of the indoor device.

5. The indoor device according to claim 2, wherein the coupling portions are integrated with the guide plate when the guide plate is molded.

6. The indoor device according to claim 2, wherein the coupling portions are provided as separate members and are coupled to the guide plate.

7. The indoor device according to claim 2, wherein the discharge hole comprises a plurality of discharge holes and the fixing portion comprises a plurality of fixing portions, wherein a corner cover that defines an exterior of each edge of the indoor device is detachably disposed on each edge of the panel between the plurality of discharge holes, and wherein the plurality of fixing portions is disposed on the corner covers.

8. The indoor device according to claim 1, wherein a coupling portion press-fitted into the fixing portion that protrudes inward to serve as a rotational shaft of the guide plate is disposed on each of both lateral ends of the guide plate, and wherein a plurality of planes corresponding to each other are provided on a circumference of each coupling portion and an inner surface of the fixing portion.

9. The indoor device according to claim 8, wherein a central portion of the coupling portion is cut in a longitudinal direction to pass through the fixing portion, or the coupling portion is elastically deformed when the guide plate rotates.

10. The indoor device according to claim 1, wherein a connection member that connects the fixing portion to the guide plate and serves as a rotational shaft of the guide plate is disposed on each of both lateral ends of the guide plate.

11. The indoor device according to claim 10, wherein the connection member comprises:

a first connection member connected to each of both lateral ends of the guide plate; and a second connection member connected to the fixing portion, and wherein the first and second connection members are rotatably coupled to each other.

12. The indoor device according to claim 11, wherein the first connection member comprises a rotational portion that protrudes to be inserted into the second connection member and a tooth portion disposed around the rotational portion, and wherein the second connection member comprises a rotational shaft that passes through the rotational portion and a restricter that contacts an outer surface of the tooth portion to selectively restrict relative rotation between the first and second connection members.

13. The indoor device according to claim 10, wherein the connection member comprises:

a mount protrusion coupled to an end of the guide plate;

a rotational portion disposed on a lower portion of the mount protrusion, wherein the rotational portion protrudes to be inserted into the fixing portion; and teeth disposed around the rotational portion.

14. The indoor device according to claim 13, wherein an opening, in which the rotational portion is accommodated, and a tooth portion corresponding to the teeth are defined in the fixing portion, and wherein a center of the opening is cut and elastically deformed when the rotational portion rotates.

15. The indoor device according to claim 1, wherein the guide plate extends along the concave portion and is opened to the outside of the indoor device.

16. The indoor device according to claim 1, wherein both lateral ends of the guide plate are formed to be rounded inward.

17. The indoor device according to claim 1, wherein the guide plate is rounded toward the panel in a direction of each of both lateral ends of the guide plate.

18. The indoor device according to claim 1, wherein the discharge hole comprises a plurality of discharge holes defined, respectively, in each of four sides of the panel, and wherein each discharge hole has a width that gradually decreases in an outward direction.

19. The indoor device according to claim 1, wherein the wind visor contacts the panel along the inner line of the discharge hole and is open in an outward direction.

* * * * *